US005528344A

United States Patent [19]

Yamaguchi et al.

[11] Patent Number: 5,528,344

[45] Date of Patent: Jun. 18, 1996

[54] IMAGE FORMING DEVICE

[75] Inventors: Yoshio Yamaguchi, Kawasaki; Hisashi Hanzawa, Inagi; Shinzo Tanaka; Nobuyuki Tanaka, both of Kawasaki, all of Japan

[73] Assignee: Fujitsu Limited, Kawasaki, Japan

[21] Appl. No.: 425,571

[22] Filed: Apr. 20, 1995

[30] Foreign Application Priority Data

Aug. 4, 1994 [JP] Japan ..... 6-183621
Oct. 27, 1994 [JP] Japan ..... 6-264206

[51] Int. Cl.[6] ..... G03G 15/00; G03G 21/00

[52] U.S. Cl. ..... 355/200; 355/208; 355/210; 355/246; 355/282; 355/285

[58] Field of Search ..... 355/203, 204, 355/200, 208, 210, 245, 282, 285, 246

[56] References Cited

U.S. PATENT DOCUMENTS

| | | | |
|---|---|---|---|
| 4,465,359 | 8/1984 | Nakahara | 355/215 |
| 4,635,010 | 1/1987 | Miyai et al. | 355/200 |
| 4,705,384 | 11/1987 | Mizutani et al. | 355/200 |
| 4,910,551 | 3/1990 | Onoda et al. | 355/200 |
| 5,448,341 | 9/1995 | Nagahara et al. | 355/200 X |
| 5,457,517 | 10/1995 | Katakabe et al. | 355/200 |

FOREIGN PATENT DOCUMENTS

| | | |
|---|---|---|
| 0618513 | 3/1994 | European Pat. Off. . |
| 4-323125 | 11/1992 | Japan . |

*Primary Examiner*—Matthew S. Smith
*Attorney, Agent, or Firm*—Armstrong, Westerman, Hattori, McLeland & Naughton

[57] ABSTRACT

The present invention relates to an image forming device such as a copying machine, a printer, or the like that records an image on a sheet of ordinary paper, more particularly to image forming device that can be installed in multiple direction, for example, vertically or horizontally. The object is to realize a device serviceable to any installation direction and to provide a stable operation independently on the installation direction and an improved reliability. The image forming device consists of an installation direction detecting unit for detecting an installation direction of the device body; and a control unit for controlling the operation of the device body according to the installation direction detected. The control unit includes the plural control sequence units each arranged in an installation direction for setting a control condition corresponding to the installation direction, and a control condition selecting unit for selecting a control sequence unit corresponding to the installation direction detected among the plural control sequence units.

29 Claims, 23 Drawing Sheets

IMAGE FORMING DEVICE

BACKGROUND OF THE INVENTION

1) Field of the Invention

The present invention relates to an image forming device such as a copying machine, a printer, or the like that records an image on a sheet of ordinary paper, more particularly to an image forming device that can be installed in multiple direction, for example, vertically or horizontally.

2) Description of the Related Art

Generally, in latent image type image forming devices such as electrophotographic recording devices to record an image on an ordinary paper, a visual image can be formed by forming an electrostatic latent image on a photosensitive drum, then supplying powder developer on the photosensitive drum by means of a developing unit, and developing the latent image on the photosensitive drum with the powder developer. Furthermore, the image of the powder developer on the photosensitive drum is transferred on a sheet of ordinary paper (recording paper). Then the sheet is separated from the photosensitive drum and then the image of the powder developer coated over the sheet is fixed on the sheet by means of a fixing unit.

In the developing process of the developing unit equipped with such an image forming device, the developer including carriers and toner or the developer including only toner is supplied to the photosensitive drum. When internal toner has been completely exhausted, the developing process cannot be continued. Hence it is needed to detect earlier the empty condition of the internal toner.

A prior art toner empty detecting mechanism will be explained by referring FIG. 23. As shown in FIG. 23, the developing unit has a toner detection sensor 91 mounted on the bottom of the toner hopper 90 holding toner. The toner detection sensor 91 produces a voltage according to the remaining amount of toner within the toner hopper 90.

A comparator 92 is arranged to compare a detection voltage with a constant slice voltage (threshold voltage). The comparator 92, as shown in FIG. 24, produces a toner empty signal when the toner detection sensor 91 outputs a detection voltage less than a slice voltage.

Where the developer includes magnetic toner, a permeability sensor, for example, is used as the toner detection sensor 91. The output voltage of the permeability sensor has the characteristic shown in FIG. 25. That is, in the case a small amount of toner (less than 1 g), the output voltage of the permeability sensor shows a linear characteristic proportional to the remaining amount of toner. Hence, when the amount of toner is small, the toner empty can be detected.

However, the prior art shown in FIGS. 23 to 25 has the following disadvantages:

The toner detection sensor 91 produces at most its output voltage of 5 volts, thus causing variations in voltage. Hence the method using a constant slice voltage as a reference value cannot detect the toner empty accurately.

Particularly, where the developing unit is detachable and attachable and the toner detection sensor 91 is mounted on the device body, the output voltage from the toner detection sensor 91 becomes smaller. As a result, the susceptible output voltage leads to an inaccurate toner empty detection.

The present applicant proposed a toner empty detecting method that can solve the above-mentioned problem in Japanese Patent Application No. 5-287654 (filed on Oct. 22, 1993 (Heisei 5)) or U.S. patent application No. 300,349, filed on Sept. 2, 1994. According to the patent application, the toner empty detecting method in which a control circuit receives the output from a toner detection sensor to detect the toner within a toner hopper is characterized by the steps of capturing the output from a toner detection sensor every fixed period; comparing the captured value with the average value of outputs from the toner detection sensor during the previous detection period; counting the times values captured during a predetermined detection period are smaller than the average value; calculating the average value of values captured during detection period; and producing an empty output when the count value obtained by comparing the calculated value with a predetermined value is larger than the predetermined value.

The above empty detecting method has the following advantages.

Adverse effect due to variations in voltage of the toner detection sensor can be removed by comparing the output value from the toner detection sensor with the average value during the previous detection period and then detecting the toner empty condition to a relative level.

When the toner empty condition is detected using only the result obtained by comparing the output value of the toner detection sensor with the average value, the toner empty condition may be erroneously detected with a small output value from the toner detection sensor because of a variation in the amount of toner associated with the rotation of the agitator (a supply roller) within the developing unit. However, the above-mentioned empty detecting method counts the times captured value is smaller than an average value during a predetermined detection period, compares the count value with the predetermined value, and produces an empty output when the count value is larger than the predetermined value. As a result, the toner empty condition can be accurately detected even to toner agitated and moved.

Changing the subject, the present inventors have vigorously studied an image forming device (Japanese Patent Application No. 5-261604 (filed on Sept. 24, 1993 (Heisei 5)) or U.S. patent application No. 220,205, filed on Mar. 3, 1994) that can form an image with no difference in quality in the horizontal and vertical installations. As a result, the following problems have been found.

As to the toner empty control, in two cases of the device body horizontally installed and the device body vertically installed, the empty output generation timing changes when an empty control is performed under a common decision condition. Hence a stable empty detection cannot be accomplished.

In the image forming step in which a sheet passes through the fixing unit, moisture contained in the sheet evaporated within the image forming device affects adversely the photosensitive drum. Particularly, the current image forming device has the structure that the fixing unit is placed above the photosensitive drum when the device body is installed vertically. Hence, the moisture effect is remarkable, compared with the horizontal installation. Ordinarily, the image forming device includes a fan to exhaust heat out of the device and cool the inside of the device. However, in the vertical or horizontal installation, since heat current with vapor ascends differently, it is difficult to cool stably the inside of the device and to exhaust stably vapor. Where the temperature in the process unit including a photosensitive drum is low at a power-on time, the vapor moisture tends to condense on the process unit, thus having significant effect on the process unit. For example, condensed moisture sweated over the photosensitive drum hastens the degradation of the photosensitive drum, thus shortening its operational life.

Usually, the device installed vertically occupies a space (a device occupying area) smaller than the device installed horizontally. Hence the device is installed vertically in most cases for space saving. However, the vertical installation has a disadvantage in stacking printed sheets. Actually the vertical installation occupies nearly the same space as that for the horizontal installation. This inconvenience cancels the merit of the vertical installation. Since printed sheets stacked on the printed surface thereof, the printed sheets must be rearranged in serial number after the printing operation, whereby this work is troublesome.

SUMMARY OF THE INVENTION

The present invention is made to overcome the above mentioned problems. An object of the present invention is to provide an image forming device that realizes a device serviceable in any installation direction and provides a stable operation independently on the installation direction and an improved reliability.

In order to achieve the above objects, according to the present invention, the image forming device that can be installed in any direction, characterized by an installation direction detecting unit for detecting an installation direction of the device body; and a control unit for controlling the operation of the device body according to the installation direction detected by the installation direction detecting unit; the control unit including a control condition selecting unit for arranging plural control sequence units in the installing direction, the plural control sequence units each for setting a control condition corresponding to the installation direction, and for selecting a control sequence unit corresponding to the installation direction detected by the installation direction detecting units from the plural control sequence units.

As described above, according to the present invention, the image forming device can adjust the control conditions according to the installation direction and allows the device to operate under the control suitable for the installation direction. The simplified configuration can realize a stable image forming operation independently to the installation direction, thus improving largely the reliability of an image forming process.

DESCRIPTION OF THE PREFERRED EMBODIMENTS

Referring to the attached drawings, explanation will be made as for an aspect of the present invention.

(a) Aspect of the Invention

Figure 1:
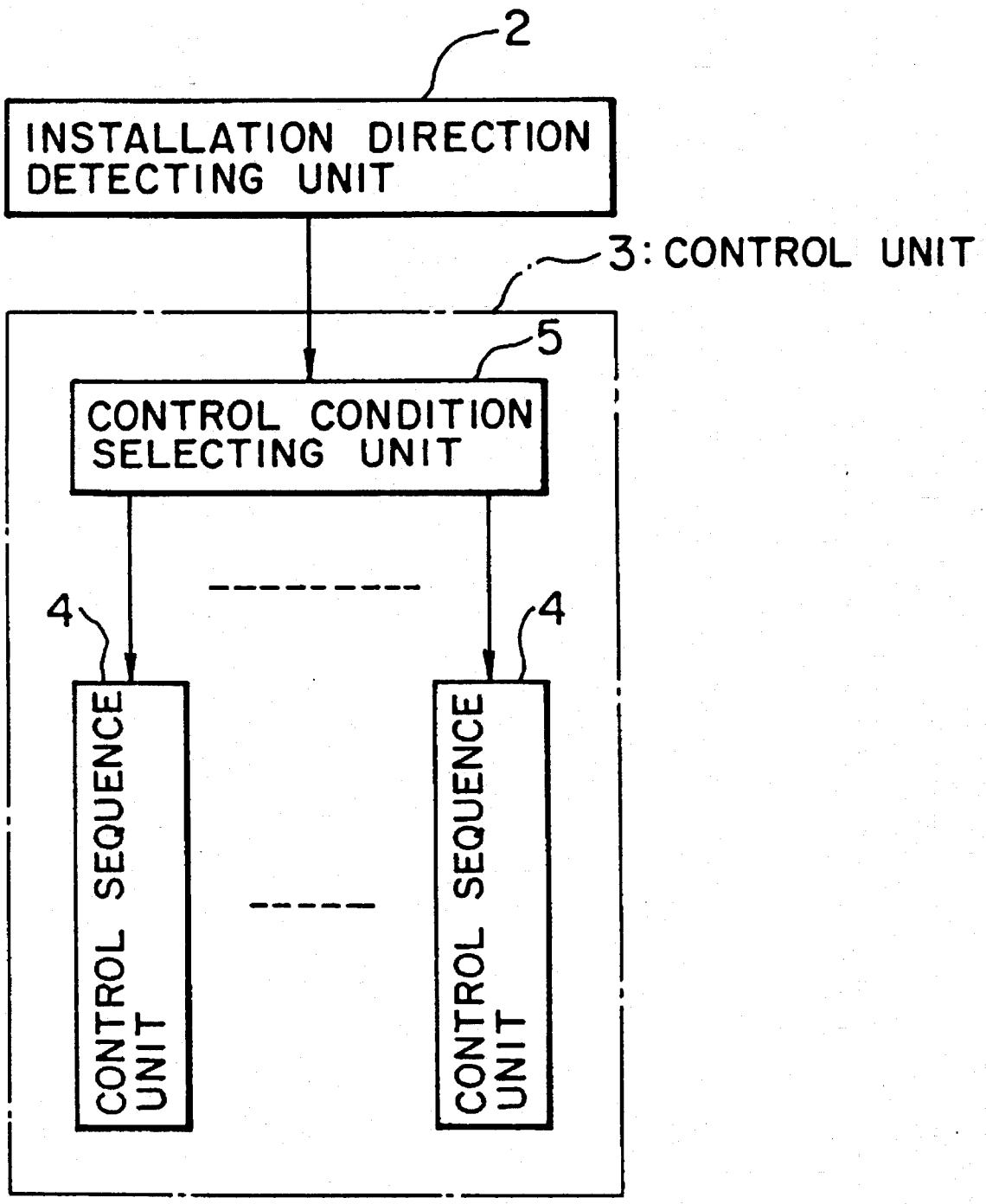
FIG. 1 is a block diagram showing an aspect of the present invention.

FIG. 1 is a block diagram showing an aspect of the present invention. The present invention relates to an image forming device having a structure that can be installed in any direction. Referring to FIG. 1, the image forming device is formed of a installation direction detecting unit 2 and a control unit 3.

The installation direction detecting unit 2 detects the installation direction of the device body. The control unit 3 controls the operation of the device body according to the installation direction detected by means of the installation direction detecting unit 2.

According to the present invention, the control unit 3 is formed of plural control sequence units 4 respectively in each installation direction to set the control condition according to the installation direction, and a control condition selecting unit 5 for selecting the control sequence unit corresponding to the installation direction detected by the installation direction detecting unit 2 from plural control sequence units (mechanical control firmware) 4.

The image forming device may include further a toner detecting unit that detects the amount of toner within the toner hopper. The control unit 3 performs a toner empty control according to the installation direction of the device body, based on the output signal from the toner detecting unit.

The plural control sequence units 4 consists of a horizontal toner empty status deciding unit that is selected by the control condition selecting unit 5 when the device body is installed horizontally and a vertical toner empty status deciding unit that is selected by the control condition selecting unit 5 when the device body is installed vertically. The horizontal toner empty status decides unit comparing the levels of output signals with a horizontal slice level value, the output signal levels sampled in one detection period during which an output signal from the toner detecting unit is sampled a prescribed number of times, the horizontal slice level value calculated by averaging levels of output signals sampled during the previous detection period. The vertical toner empty status deciding unit compares the levels of output signals with a vertical slice level value, the output signal levels sampled in one detection period during which an output signal from the toner detecting unit is sampled a prescribed number of times, the vertical slice level value calculated by applying the maximum level and the minimum level of output signals sampled during the previous detection period to the formula [(maximum value−minimum value)×k+minimum value; $0<k<1$].

The horizontal toner empty status deciding unit decides as a near empty or toner empty the case where the number of times the level value of an output signal from the toner detecting unit is less than the horizontal slice level during one detection period is a prescribed number of times or more. The vertical toner empty status deciding unit decides as a near empty or toner empty the case where the number of times the level value of an output signal from the toner detecting unit is continuously less than a vertical slice level during one detection period a prescribed number of times or more.

The horizontal toner empty status deciding unit decides as a near empty or toner empty the case where the number of times the level value of an output signal from the toner detecting unit is less than the horizontal slice level during one detection period is a prescribed release number of times or less. The vertical toner empty status deciding unit decides as a near empty or toner empty the case where the number of times the level value of an output signal from the toner detecting unit is continuously more than a vertical slice level during one detection period a prescribed release number of times or more.

The horizontal toner empty status deciding unit decides as a toner empty the case where a detection period occurs continuously a prescribed number of times, the detection period during which the number of times the level value of an output signal from the toner detecting unit is less than the horizontal slice level during one detection period. The vertical toner empty status deciding unit decides as a toner empty the case where the number of times a detection period occurs continuously a prescribed number of times, the detection period during which the level value of an output signal from the toner detecting unit is continuously less than a vertical slice level during one detection period a prescribed number of times or more.

The horizontal toner empty status deciding unit releases a toner empty decision where the number of times the level value of an output signal from the toner detecting unit is less than the horizontal slice level is less than a prescribed release number of times during one detection period. The vertical toner empty status deciding unit releases a toner empty decision where the level value of an output signal from the toner detecting unit is continuously more than a vertical slice level during one detection period a prescribed release number of times or more.

The installation direction detecting unit 2 can be formed of a shutter piece rocking according to the installation direction of the device body; and an optical sensor for outputting a detection signal regarding the installation direction of the device body when the shutter piece opens or cuts an optical path according to the rocking position of the shutter piece.

The toner detecting unit can be equipped outside the toner hopper and formed as a permeability sensor that detects the magnetism of magnetic toner within the toner hopper.

Moreover, the detection period is set to or substantially to one rotation cycle of an agitator that agitates toner in the toner hopper, and the output signal from the toner detecting unit is not sampled during the first detection period of the agitator.

The image forming device further includes a fan for ventilating and cooling the inside of the device body; and the control unit controls the fan according to the installation direction of the device body.

The plural control sequence units (or a fan control firmware for cooling the inside of the device) 4 consists of a horizontal fan control unit that is selected by the control condition selecting unit 5, in the horizontal state where the device body is horizontally installed and arranged substantially in parallel with a fixing unit and a process unit including a photosensitive drum; and a vertical fan control unit that is selected by the control condition selecting unit 5, in the vertical state where the device body is vertically installed and the process unit is arranged above the fixing unit.

The horizontal fan controlling unit drives the fan at a predetermined horizontal drive timing when the device is powered on. The vertical fan control unit drives the fan at a vertical drive timing slower than the horizontal drive timing when the device is powered on. The image forming device further includes a recording paper passage detecting unit for detecting that a recording paper on which an image is created passes through the fixing unit. The vertical fan control unit drives the fan when the recording paper passage detecting unit detects a passage of the recording paper in a predetermined period of time from the power-on operation.

The horizontal fan control unit stops the fan at a predetermined horizontal stop timing after a completion of an image forming operation. The vertical fan control unit stops the fan at a vertical stop timing slower than the horizontal stop timing after a completion of an image forming operation. The horizontal fan control unit rotates and drives the fan at a predetermined horizontal number of revolutions. The vertical fan control unit rotates and drives the fan at a predetermined vertical number of revolutions larger than the horizontal number of revolutions.

Furthermore, the control unit 3 controls the operation of the fixing unit according to the installation direction of the device body.

The plural control sequence units (or fixing unit control firmware) 4 consists of a horizontal fixing unit control unit that is selected by the control condition selecting unit 5, in the horizontal state where the device body is horizontally installed and arranged substantially in parallel with a fixing unit and a process unit including a photosensitive drum; and a vertical fixing unit control unit that is selected by the control condition selecting unit 5, in the vertical state where the device body is vertically installed and the process unit is arranged above the fixing unit.

The horizontal fixing unit control unit drives the roller of the fixing unit at a predetermined horizontal drive timing when the device is powered on. The vertical fixing unit control unit drives the roller of the fixing unit at a vertical drive timing slower than the horizontal drive timing when the device is powered on. The horizontal fixing unit control unit controls a heater in the fixing unit at a predetermined fixing temperature when the device is powered on. The vertical fixing unit control unit once elevates the heater to a temperature higher than the predetermined fixing temperature in the power-on operation and then sets it to the predetermined fixing temperature.

The horizontal fixing unit control unit starts heating the heater of the fixing unit at a power-on operation and then starts a temperature stabilizing control that holds the heater of the fixing unit at the predetermined fixing temperature, at a predetermined horizontal temperature control start timing. The vertical fixing unit control unit starts heating the heater of said fixing unit at a power-on operation and then starts a temperature stabilizing control that holds the heater of the fixing unit at a predetermined fixing temperature, at a vertical temperature control start timing slower than the horizontal temperature control start timing.

Moreover, the horizontal fixing unit control unit stops the rotation of the roller in the fixing unit at a predetermined horizontal stop timing after a completion of an image forming operation. The vertical fixing unit control unit stops rotating the roller in the fixing unit at a vertical stop timing slower than the horizontal stop timing after a completion of an image forming operation. The horizontal fixing unit control unit stops a temperature control that the heater in the fixing unit is maintained at a predetermined fixing temperature, at a predetermined horizontal stop timing after a completion of an image forming operation. The vertical fixing unit control unit stops a temperature control that the heater in the fixing unit is maintained at a predetermined fixing temperature, at a vertical stop timing slower than the horizontal stop timing after a completion of an image forming operation.

According to the present invention, the image forming device can operate in any installation state including either a horizontal state where the device body is arranged horizontally and substantially in parallel with a fixing unit and a process unit including a photosensitive drum, or a vertical state where the device body is arranged vertically and the process unit is arranged above the fixing unit; and includes a moisture absorption sheet between the fixing unit and the process unit.

According to the present invention, the image forming device operable in any installation state including either a horizontal state where the device body is arranged horizontally or a vertical state where the device body is arranged vertically, consists of a horizontal stack unit formed on an upper surface of said device body, for accommodating a recording sheet with an image formed thereon ejected out of the device body, with the image formed surface down; and a detachable/attachable vertical stacker equipped with the device body against the horizontal stack unit where the device body is installed vertically. A stack space for a recording sheet is formed between the horizontal stack unit and the vertical stacker.

Where the device body is installed vertically, the device body has a paper ejection aperture arranged downward for ejecting the recording paper to the stack space, and a lower space extending downward from the paper ejection aperture under the horizontal stack unit.

A pressure member can be mounted to the vertical stacker member for pressing a recording paper ejected from the paper ejection aperture against the horizontal stack unit. The vertical stacker member can be formed in a U-shaped form.

In the image forming device according to the present invention shown in FIG. 1, the installation direction detecting unit 2 detects an installation direction of the device body. The control condition selecting unit 5 selects a control sequence unit corresponding to the installation direction among plural control sequence units 4 to control the operation of the device body. Thus the device can be controlled under control condition corresponding to the installation direction and operate under control suitable the installation direction.

The control unit 3 performs a toner empty control according to the installation direction of said device body, based on the output signal (a detection signal regarding the amount of toner within the toner hopper) from the toner detecting unit. Thus the toner empty control can be made independently on the installation direction.

The installation direction detecting unit 2 is formed of a shutter piece and an optical sensor. The shutter piece opens and shuts according to the rocking position thereof and the optical sensor outputs a detection signal regarding the installation direction of the device body. Thus the simplified configuration can detect easily the installation direction of the device body.

The toner detecting unit is equipped outside said toner hopper and formed as a permeability sensor. Thus a cartridge-type toner case can detect the amount of toner held within the toner hopper from outside the toner hopper.

The detection period is set to or substantially to one rotation cycle of an agitator that agitates toner in the toner hopper. Thus the toner empty control can be made without being influenced by the effect of toner movement within the toner hopper during one rotation of the agitator. The output signal from the toner detecting unit is not sampled during the first detection period of the agitator. Thus the toner empty control can be made without using the unstable output signal at the initial operational stage.

According to the present invention, the control unit 3 can control the operation of the fan according to the installation direction of the device body. Hence, where the device body is installed in the direction where moisture vapor is generated due to the recording paper passing through the fixing unit affects the process unit, the control unit 3 sets the process unit to a higher temperature at a power-on time, suppresses the temperature rise after a completion of an image forming operation, or controls the fan to increase its air delivery rate. Thus it is prevented that moisture vapor is sweated in the process unit. The effect due to heat transferred to the process unit after a completion of an image forming operation can be prevented.

According to the present invention, the control unit 3 can control the operational status of the fixing unit according to the installation direction of the device body. Hence, where the device body is installed in the direction where moisture vapor is generated due to the recording paper passing through the fixing unit affects the process unit, the control unit 3 sets the process unit to a higher temperature at a power-on time, or suppresses the temperature rise after a completion of an image forming operation. Thus it is prevented that moisture vapor is sweated in the process unit. The effect due to heat transferred to the process unit after a completion of an image forming operation can be prevented.

In the image forming device according to the present invention, where the device body is vertically installed, a moisture absorption sheet is arranged between the fixing unit and the process unit. The moisture absorption sheet absorbs moisture vapor generated from the recording paper which passes through the fixing unit, thus preventing the moisture vapor from influencing badly the process unit.

In the image forming device according to the present invention, where the device body is vertically installed, the vertical stacker member is mounted on the device body to form a stacker space for recording paper between the horizontal stack unit and the vertical stacker member. Thus recording paper can be certainly stacked in the compact space.

Where the device body is installed vertically, the entire paper ejected from the lower paper ejection aperture drops into the lower space, thus being stacked with the image forming surface up toward the horizontal stack unit. Thus the recording paper can be certainly stacked in the order of page (face down stack).

The pressure member mounted to said vertical stacker member presses a recording paper ejected from said paper ejection aperture against said horizontal stack unit and stacks it with the image forming surface up toward the horizontal stack unit. The recording paper can be certainly stacked in the order of page. The recording paper curled can be stacked stably.

Furthermore, since the vertical stacker member is formed in a U-shaped form, the recording paper can be taken out after an image formation independently of the size of the recording paper.

As described above, according to the present invention, the image forming device can control under the control condition according to the installation direction and operate under the control suitable to the installation direction. Hence the simplified configuration can realize the stable image forming operation without depending on the installation direction, whereby the reliability of the image forming device can be largely improved.

The toner empty control without depending on the installation direction can be performed by the toner empty control according to the installation direction of the device body. Hence the toner empty detection/display or the near empty detection/display can be performed stably.

Since the operational condition of the fan can be controlled according to the installation direction of the device body, the necessary air volume can be obtained at a suitable timing. Hence the temperature rise in the device body due to a change in installation direction, a change in the passage of moisture vapor generated from the recording paper passing through the fixing unit, and the effect due to sweating can be certainly prevented.

Since the operational condition of the fixing unit can be controlled according to the installation direction of the device body, the necessary air volume can be obtained at a suitable timing. Hence the temperature rise in the device body due to a change in installation direction, and the effect due to sweating of moisture vapor generated from the recording paper passing through the fixing unit can be certainly prevented.

According to the image forming device of the present invention, where the device body is vertically installed, the moisture absorption sheet absorbs moisture vapor produced from the recording paper passing through the fixing unit. Hence, the influence of the moisture vapor onto the process unit can be certainly prevented.

Moreover, according to the image forming device of the present invention, where the device body is vertically installed, a stack space for recording paper is formed between the horizontal stack unit and the vertical stacker unit. Hence the compact space can stack certainly recording paper, thus leading to saving space. The merits of the vertical installation can be surely enhanced.

The recording paper can be certainly stacked in the page order by forming the lower space under the horizontal stack unit and arranging the pressure member which presses the recording paper against the horizontal stack unit. Since it is unnecessary to rearrange the recording paper in the order of page after the completion of the image formation, the workability can be largely improved by cutting the troublesome matter.

The U-shaped vertical stacker member allows the recording paper to be easily taken out after the image forming process, thus largely improving the workability.

(b) Configuration of the Image Forming Device

Figure 3:
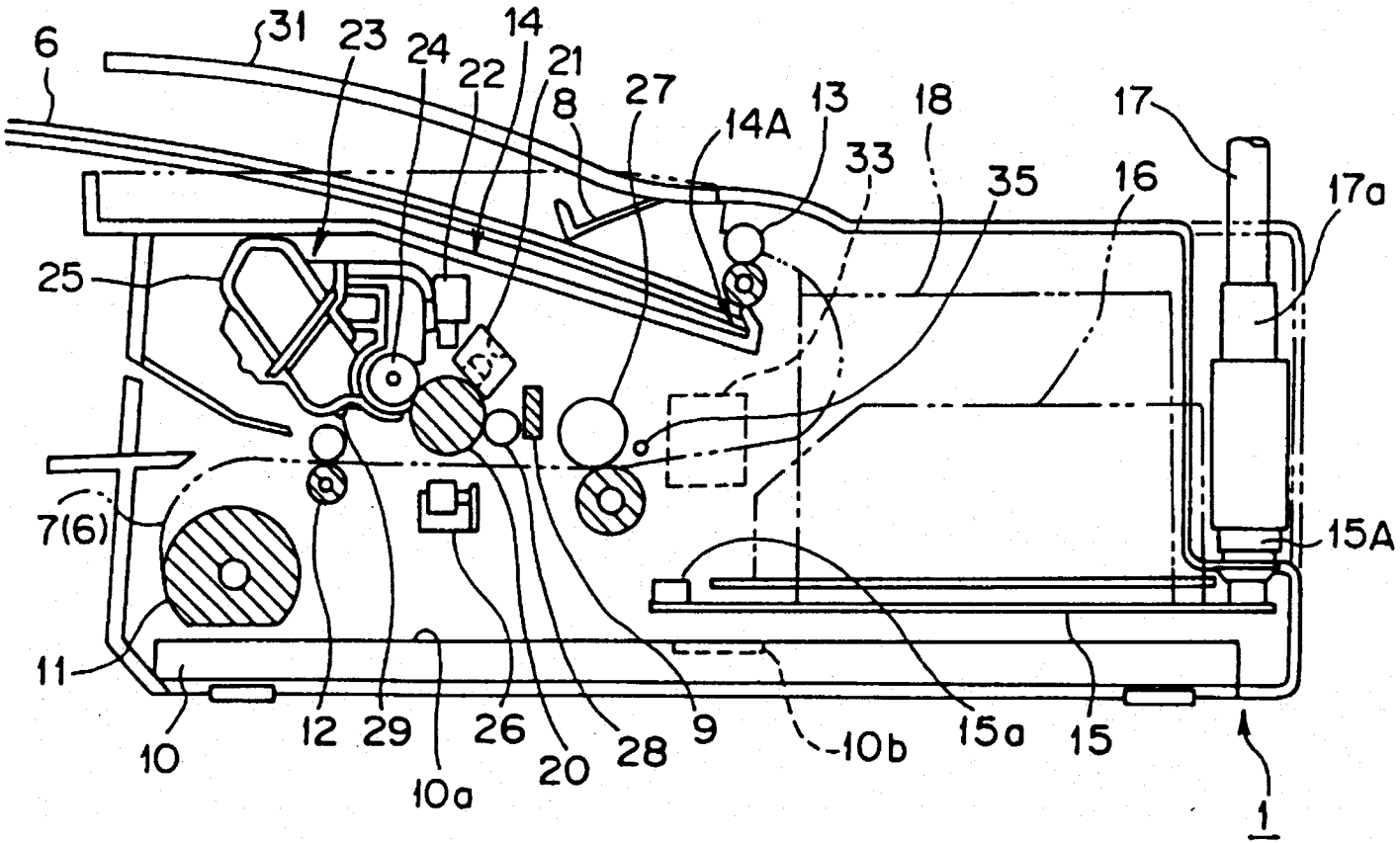
FIG. 3 is a vertical cross sectional view schematically showing the configuration of an image forming device according to the present embodiment.
Figure 4:
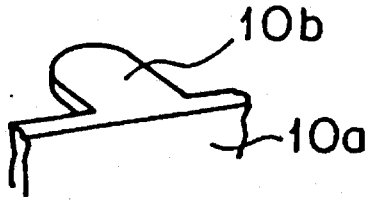
FIG. 4 is an enlarged perspective view showing a pawl portion formed in a paper cassette according to the present embodiment.
Figure 5:
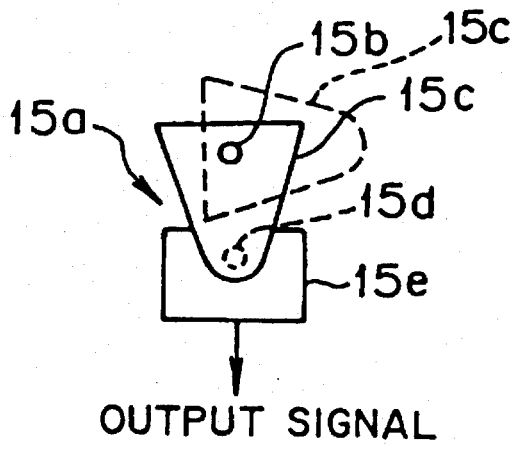
FIG. 5 is a side view showing the outline structure of the installation direction detecting unit according to the present embodiment.
Figure 6:
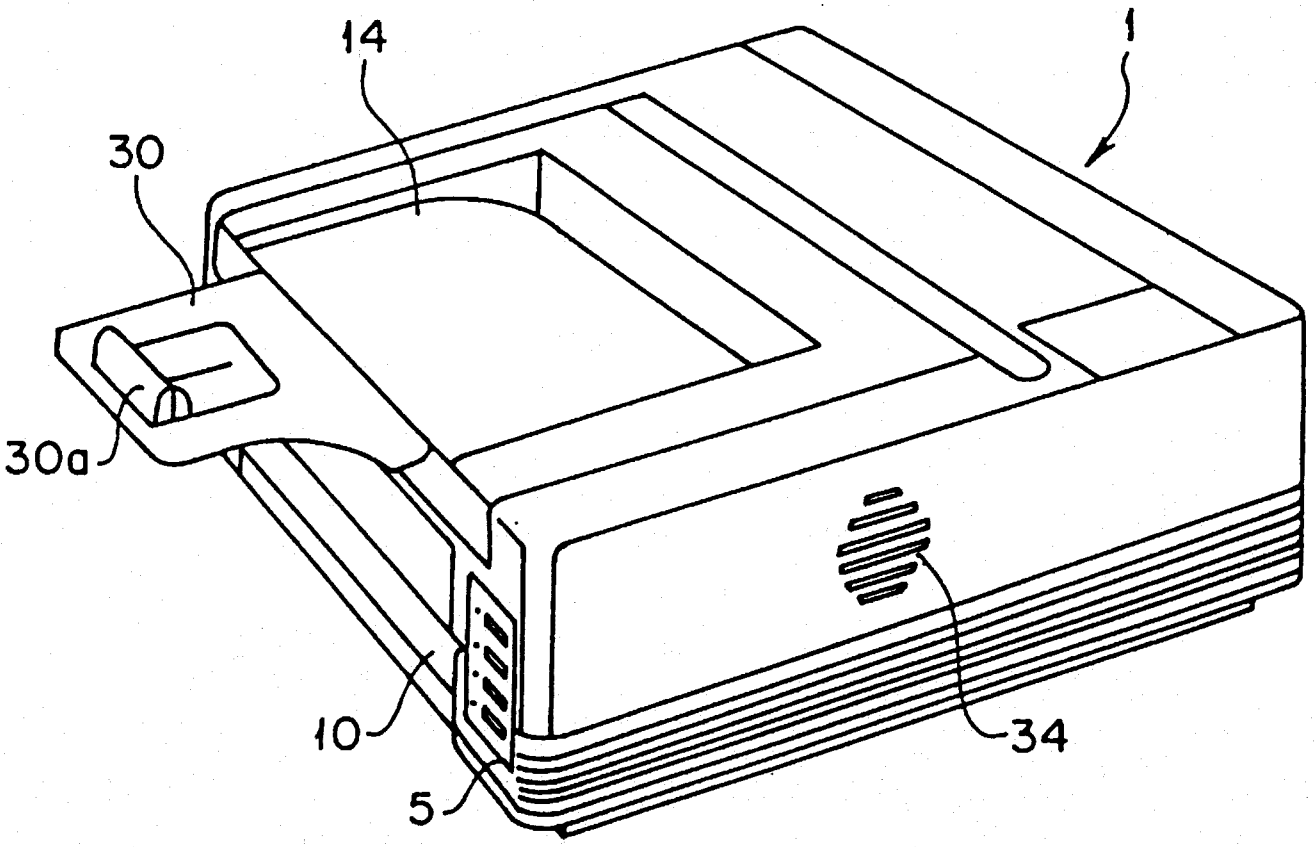
FIG. 6 is a perspective view showing the horizontal installation of the image forming device according to the present embodiment.
Figure 7:
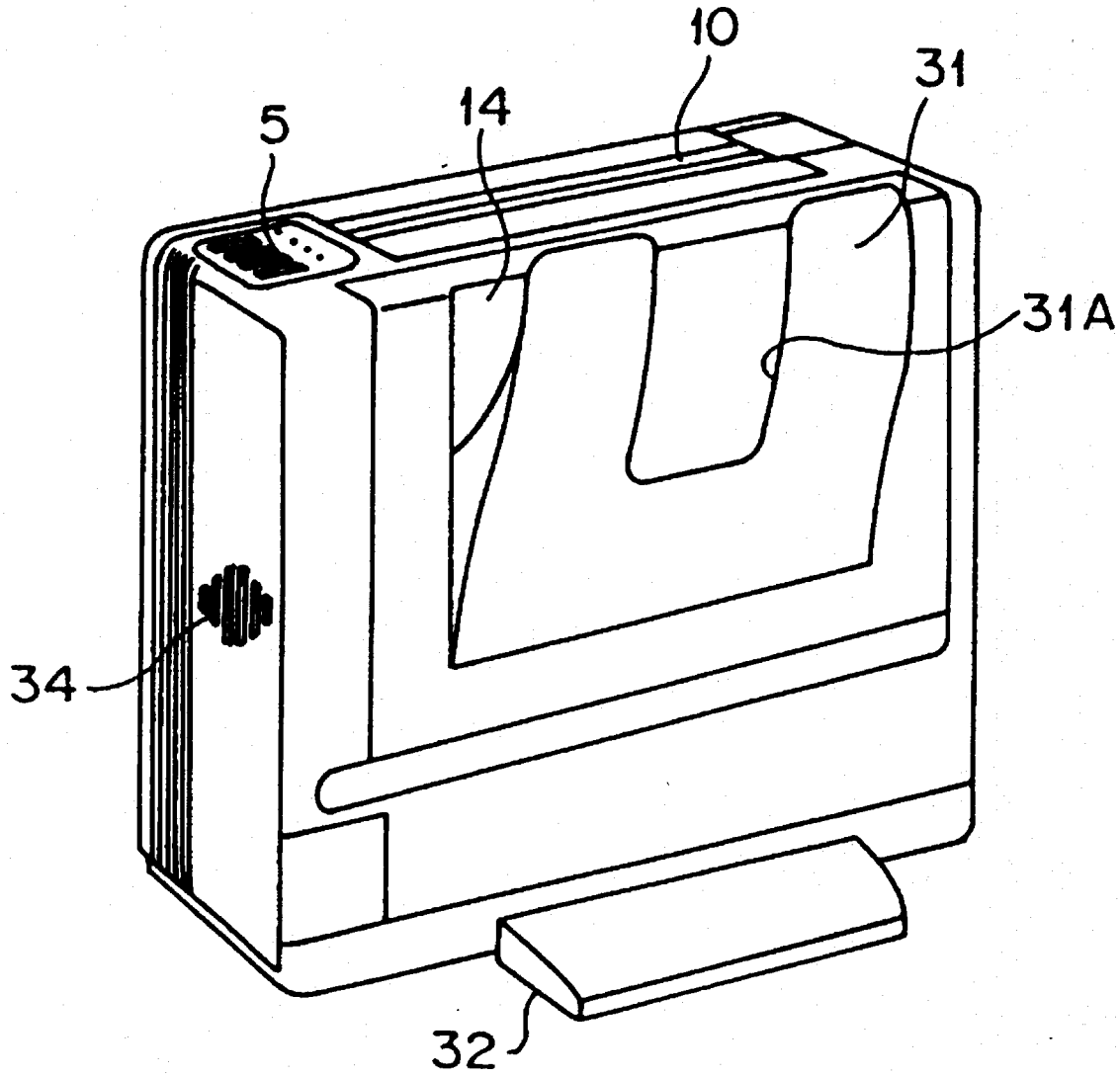
FIG. 7 is a perspective view showing the vertical installation of the image forming device according to the present embodiment.

FIG. 3 is a vertical cross sectional view schematically showing the configuration of an image forming device according to the present embodiment. FIG. 4 is an enlarged perspective view showing a pawl portion formed in a paper cassette according to the present embodiment. FIG. 5 is a side view showing the outline structure of the installation direction detecting unit (optical sensor) according to the present embodiment. FIG. 6 is a perspective view showing the horizontal installation (laying-state) of the image forming device according to the present embodiment. FIG. 7 is a perspective view showing the vertical installation (stand-state) of the image forming device according to the present embodiment. In this embodiment, the case where the image forming device is a cleanerless-type electrophotographic printer will be explained here.

Referring FIG. 3, numeral 20 represents a photosensitive drum. The photosensitive drum 20 is, for example, an aluminium drum of 24 mm outer diameter over which a function-separation type organic photosensitive of about 26 μm thick is coated. The photosensitive drum 20 is driven at a peripheral speed of 25 mm/sec by means of a drive motor (not shown).

Numeral 21 represents a pre-charger. The pre-charger 21 charges evenly the surface of the photosensitive drum 20, for example, at −650 volts. The pre-charger 21 is, for example, a contactless charger formed of Scorotron.

Numeral 22 represents an optical unit. The optical unit 22 exposes the photosensitive drum 20 evenly charged to an image light to form an electrostatic latent image on the surface of photosensitive drum 20. The optical unit 22 is, for example, an LED optical system formed of a combination of an LED array and a Celfoc array. An electrostatic latent image charged to −50 to −100 volts is created on the photosensitive drum 20 by image-exposing the photosensitive drum 20 to the image pattern by means of the optical unit 22.

Numeral 23 represents a developing unit. The developing unit 23 supplies a developer made from magnetic carriers and magnetic toner over the photosensitive drum 20 and develops an electrostatic latent image on the photosensitive drum 20 to visualize it (to be described later by referring to FIGS. 8 and 9). Numeral 24 represents a developing roller that carries a developer to the photosensitive drum 20 in the developing unit 23, and 25 represents a toner cartridge (toner hopper). The cartridge 25 which is filled with developer made from magnetic carriers and magnetic toner is mounted to the developing unit 23 exchangeable at a toner empty time.

Numeral 26 represents a transfer unit that electrostatically transfers a toner image formed on the photosensitive drum 20 onto a recording paper (sheet, paper) 6. The transfer unit 26, for example, a corona discharger, applies a voltage of +5 to +10 kV onto a corona wire to generate electric charges through a corona discharge and then charges the back surface of the recording paper 6 so that an toner image formed on the photosensitive drum 20 is transferred onto the recording paper 6. It is desirable to use a constant current source acting as a power supply that can reduce a drop in transfer efficiency due to circumstances by supplying constant electric charges onto the recording paper 6.

Numeral 27 represents a fixing unit that thermally fixes a toner image on the recording paper 6. The fixing unit 27, for example, is formed of a heat roller in which a halogen lamp (refer to numeral 52 shown in FIG. 2) acting as a heat source is built internally, and a pressure roller (backup roller). The recording paper 6 is passed between the pressure roller and the heat roller under suitable pressure while it is heated with the heat roller so that the toner image is fixed on the recording paper 6. The fixing and driving unit 53 (to be described later with FIG. 2) rotates and drives the heat roller and the pressure roller.

Numeral 28 represents a dispersing (uniforming) member. The dispersing unit 28 is in contact with the photosensitive drum 20 and disperses locally remaining toner on the photosensitive drum 20. Thus the developing unit 23 facilitates the toner collection. The dispersing unit 28, for example, is formed of a conductive member. Numeral 29 represents a toner sensor (toner detecting unit) that detects the presence or absence of toner (the amount of toner) left in the toner cartridge 25. The details will be described later.

Numeral 10 represents a paper cassette containing recording sheets 6. The paper cassette 10 is mounted on the lower portion of the device body 1 (the lower portion of the device body 1 horizontally installed, as shown in FIG. 6), and attached to or detached from the front surface (on the left side in FIG. 3) of the device.

A pawl portion **10*b*, as shown in FIG. 4, is arranged in the middle of each side plate 10*a* of the paper cassette 10 so as to protrude inward the paper cassette 10 from the top end. Where the device body 1 is installed vertically as shown in FIG. 7 (installed with the right side down in FIG. 3), the pawl portion 10*b* supports the recording paper 6 contained in the paper cassette 10** so as not to fall toward the inside of the device unit. Thus it is possible to transfer recording paper stably.

Numeral 11 represents a pickup roller. The pickup roller 11 picks the recording paper 6 in the paper cassette 10 and ejects it out of the paper cassette 10. Numeral 12 represents a photoresist roller. The pickup roller 11 sends the recording paper 6 ejected from the paper cassette 10 against the roller 12 to arrange rightly the end of the recording paper 6. Then the photoresist roller 12 transfers the recording paper 6 to the transfer unit 26.

Numeral 13 represents a paper ejection roller. The paper ejection roller 13 ejects the recording paper 6 on which a toner image is thermally printed by the fixing unit 27 into the stacker 14.

Numeral 7 represents a carrying path through which the recording paper 6 is introduced with the rollers 11 to 13.

The stacker 14 which acts as a horizontal stacking unit is arranged over the upper surface (the upper surface of the device body 1 horizontally installed, as shown in FIG. 6) of the device body 1, and contains the recording paper 6 ejected from the ejection paper roller 13 with the image forming surface down (or facedown).

In the present embodiment, where the device body I is vertically installed, as shown in FIG. 7, the vertical stacker member 31 is mounted on the device body 1 so as to face with the stacker 14. A space for the stacker of the recording paper 6 is formed between the horizontal stacker 14 and the vertical stacker member 31. The vertical stacker member 31 can be attached to or detached from the device body 1 and has a recessed portion 31A cut in a U-shaped form in the middle thereof, as shown in FIG. 7.

According to the present embodiment, where the device body 1 is vertically installed as shown in FIG. 7, the paper ejection outlet (the portion where the paper ejection roller 13 is installed) through which the recording paper 6 is ejected from the device unit 1 to the stack space is arranged downward. The lower space 14 A extending further downward from the paper ejection outlet (the position of the paper ejection roller 13) is formed under the stacker 14 of the present embodiment.

Moreover, a pressure member 8, as shown in FIG. 3, that presses the lower portion of the recording paper 6 ejected from the paper ejection outlet against the stacker 14 is mounted on the surface facing the stacker 14 of the vertical stacker member 31. The pressure member 8 which is formed, for example, of a polyester film applies a suitable pressure to the recording paper 6 so that the recording paper 6 can be pressed against the stacker 14 without disturbing an ejection of paper toward the stack space.

Numeral 15 represents a printed board mounting the control systems of the device (to be described later by referring to FIG. 2). The printed board 15 has its end on which an optical sensor **15*a*** acting as an installation direction detecting unit being a characteristic forming element of the invention.

A shutter piece (shutter) **15*c* is journaled rotatably with the rotational shaft 15*b* inside the photo sensor 15*a*, and includes a photo coupler (optical sensor) 15*e* formed of a light receiving element 15*d* and a light emitting element (not shown) arranged so as to face to each other. The opposite end of the rotational shaft 15*b* for the shutter piece 15*c* extends toward the optical path running between the light receiving element 15*d* and the light emitting element in the photo coupler 15*e*. The shutter piece 15*c* rotates around the rotational shaft 15*b*** while the end portion always moves in the direction of gravity.

Where the device body 1, for example, is horizontally installed (refer to FIGS. 3 and 6), the optical sensor **15*a* detects the device in the horizontal installation state with the shutter piece 15*c* cutting the optical path between the light receiving element 15*d* and the light emitting element, as shown with the solid lines. Where the device body 1, for example, is vertically installed (refer to FIG. 7), the photo sensor 15*a* detects the device in the vertical installation state when the light receiving element 15*d* receives light from the light emitting element with the shutter piece 15*c* deviated from the optical path between the light receiving element 15*d*** and the light emitting element, as shown with the dotted lines.

Numeral 16 represents a power supply that supplies electric power to various units, and 17 represents an interface connector that is connected to an external cable **17*a* and is inserted in the device to connect to the connector 15A of the printed board 15. Numeral 18** represents an option board that mounts another kind of emulator circuit, a font memory, or the like.

33 represents a fan unit that exhausts heat and dust out of the device body 1 to ventilate and cool the inside thereof. The fan unit 33 is mounted inside the device body near to the fixing unit 27. As shown in FIGS. 6 and 7, in the device body, vents 34 are formed to the position of the fan unit 33. The fan unit 33 exhausts heat and dust inside the device through the vents 34. The fan unit 33 is rotatably driven by means of the fan drive unit 47 to be described later by referring to FIG. 2.

Numeral 35 represents a light reflex-type optical sensor that detects the end of the recording paper 6 sent from the fixing unit 27. The optical sensor 35 acts as a recording paper passage detecting unit that detects the recording paper 6 on which an image is created passing through the fixing unit 27.

Numeral 9 represents an moisture absorbing sheet (e.g. no woven fabric) arranged between the process unit including the photosensitive drum 20 and the fixing unit 27.

Referring to FIGS. 6 and 7, numeral 5 represents an operational panel arranged on the front surface of the device body 1 to designate various operations, and 30 represents a paper guide. Where the device body is horizontally installed, as shown in FIG. 6, the paper guide 30 is mounted on the end of the stacker 14 and functions to support the end of the recording paper 6 ejected to the stacker 14. The paper contact member 30*a* is slidably arranged to the end of the paper guide 30. The paper contact member 30*a* is in contact with the end of the recording paper 6 ejected into the stacker 14 and functions to arrange the end position. The paper contact member 30*a* can be slidably arranged to the position corresponding to the size of the recording paper 6. Furthermore, the numeral 32 represents a stand. The stand 32, as shown in FIG. 7, is vertically installed on the side surface of the lower portion (installation surface side) of the device body 1 to support the device body 1.

The basic printing operation of the image forming device will be explained below. After the charger 21 charges evenly the surface of the photosensitive drum 20 at −650 volts, the optical unit 22 performs an image exposure. Thus an electrostatic latent image is created, with the background of the photosensitive drum 20 being at −650 volts and the printing unit being at −50 to −100 volts.

A developing bias voltage (−300 volts) is applied on the developing roller 24 of the developing unit 23. The electrostatic latent image is developed with the magnetic polymer toner negatively charged by previously agitating together with magnetic carriers by means of the developing unit 23. Then a toner image is formed.

The pickup roller 11 picks up the recording paper 6 out of the paper cassette 10 and then the photoresist roller 12 adjusts in good order the end thereof. Then the recording paper 6 is transferred toward the transfer unit 26.

The toner image on the photosensitive drum 20 is transferred electrostatistically onto the recording paper 6 by means of the transfer unit 26. The toner image is fixed on the recording paper 6 by means of the fixing unit 27. The recording paper 6 fixed is ejected out of the paper ejection roller 13 into the stacker 14 through the U-shaped carrying path 7.

The dispersing member 28 scatters the toner and the charges remaining on the photosensitive drum 20 after the transfer operation. The remaining toner on the photosensitive drum 20 arrives at the developing unit 23 through the charger 21 and the optical unit 22 and collected by the developing roller 24 at the same time when the next developing process is carried out. The collected toner is recycled in the developing unit 23.

Generally speaking, since the transfer efficiency of the developer to the recording paper 6 is not 100%, toner (developer) would leave somewhat on the photosensitive drum 20. For that reason, it is needed to remove the remaining toner out of the photosensitive drum 20. However, it is undesirable to remove the residual toner with a cleaner. In order to remove the residual toner with a cleaner, a residual toner storing mechanism is needed, thus leading to a large-sized image forming device. The toner removed from the photosensitive drum which is not recycled is uneconomical. Moreover, the toner disposal causes an environmental problem.

In the present embodiment, the cleanerless process described above is adopted. In the cleanerless process, the dispersing member 28 disperses toner locally gathered to reduce the amount of toner per area, whereby the developing unit 23 can easily collect toner. Furthermore, the charging potential on the photosensitive drum 20 can be uniformed by suppressing the filter effect of ion shower of the charger 21. An image can be suitably exposed on the photosensitive drum 20 by suppressing the exposure filter effect in an image exposing step.

In the cleanerless process, a toner disposal mechanism and a disposal toner storing space are not needed, thus resulting in a small image forming device, and no toner which does not contribute to printing is economical. Disposing no toner does not pollute the environment. Removing toner on the photosensitive drum 20 with a cleaner scrapes the surface of the photosensitive drum 20. However, the cleanerless process prolongs the operational life of the photosensitive drum 20.

In the recording process of the image forming device shown in FIG. 3, as described above, the charger 21 is uniformly charged with the toner stuck on the photosensitive drum 20 and the optical unit 22 performs an image exposure. The developing unit 23 collects the transfer remaining toner collecting operation, together with the developing process by the optical unit 22.

In the recording process, an important matter is to carry out collecting toner on the photosensitive drum 20, together with the developing process. Let us explain the case where the toner is collected with the photosensitive drum 20 and toner negatively charged. The surface potential of the photosensitive drum 20 is set at −50 to −1000 volts by means of the charger 21. The potential of the exposure unit is dropped to 0 to—several ten volts due to the image exposure to the photosensitive drum 20. On the other hand, at the developing operation, a developing bias voltage (e.g. −300 volts) being nearly a middle value between the surface potential and the latent image potential is applied to the developing unit 23 and the developing roller 24.

In the developing step, the negatively charged toner stuck on the developing roller 24 creates an electrostatic latent image on the photosensitive drum 20 by the electric field produced on the developing bias voltage and the latent image potential. In this cleanerless process, while the developing step is carried out, the transfer remaining toner dispersed on the photosensitive drum 20 in the uniforming process by means of the dispersing member 28 is collected from the photosensitive drum 20 to the developing roller 24 by the action of the electric field between the developing bias voltage and the surface potential.

Furthermore, in the 1.5 component developing method, since the magnetic brush (not shown) formed on the developing roller 24 is in contact with the photosensitive drum 20, the mechanical sweep force of the magnetic brush decreases the mechanical adhesive force of the remaining toner. Since the magnetic attractive force occurs between the carriers of the magnetic brush and the remaining toner (magnetic toner). This makes it easy to collect the remaining toner.

The above-mentioned image forming device can be made in very small size because of no cleaner or the like. As shown in FIG. 3, the device body including the paper cassette 10 is 350 mm long, 345 mm wide, and 130 mm high. Hence, the device can be easily installed as a personal-use printer on the top of a desk.

According to the present invention, the image forming device can form images even in the case where the device body is horizontally installed (laid), with the paper cassette 10 in parallel to the installation surface, as shown in FIG. 6, or the case where the device body 1 is vertically installed (stands), with the paper cassette 10 vertically to the installation surface, as shown in FIG. 7.

In the horizontally-installed state shown in FIG. 6, the paper guide 30 is mounted on the end of the stacker 14. The paper guide 30 supports the end of the recording paper 6 ejected to the stacker 14. The paper contact member 30*a* arranges the end position of the recording paper 6. Since the paper cassette 10 is attached to or detached from the front surface of the device, the paper can be fed easily. The operational panel 5 can be operated out of the front surface of the device. Since the recording paper 6 is ejected toward the front side of the device along the stacker 14 and the paper guide 30, it can be removed easily and smoothly out of the front side of the device.

In the vertically-installed state shown in FIG. 7, the device body 1 can be installed on the installation surface, with the interface connector 17 (refer to FIG. 3) of the device body down. The vertical stacker 31 which supports upright the recording paper 6 ejected onto the stacker 14 is mounted so as to face the stacker 14 of the device body 1 so that the recording paper 6 in the vertically installed device can be prevented from falling. Since the stand 32 can be attached on the side surface of the lower portion (installation surface) of the device body 1, the device body 1 vertically installed can be prevented from falling, whereby the device body 1 can be vertically installed stably and supportably.

In the image forming device according to the present embodiment, where the device body 1 is vertically installed, a stack space for the recording paper 6 can be formed between the stacker 14 and the vertical stacker member 31 by mounting the vertical stacker member 31 facing the stacker 14 to the device body 1. Hence, the recording paper 6 can be certainly stacked in the compact space. This feature can contribute to space saving and use certainly the merit of the vertical installation.

Where the device body 1 is vertically installed, the recording paper 6 is ejected out of the paper ejection outlet (paper ejection roller 13) and then drops into the lower space 14A. Hence the recording paper 6 is certainly stacked in page order (printing order) into the stacker 14 (facedown stack), with the image forming surface down. Hence it is omitted to rearrange sequentially the recording paper 6 after the image forming completion so that the workability can be largely improved.

The recording paper 6 is pressed against the side of the stacker 14 by means of the pressure member 8 to stack it with the image forming surface faced with the stacker 14. Thus the recording paper 6 can be certainly in the page order (printing order). The workability can be largely improved by omitting rearranging the stacking order of the recording paper 6 after the image forming process. A curled recording paper 6 results in a bad stacked state. Since the pressure member 8 presses the lower portion of the recording paper 6 against the stacker 14, it can stack stably the curled recording paper 6.

Moreover, the U-shaped cut portion 31A formed in the vertical stacker member 31 allows printed recording paper 6 to be easily taken out regardless of the size of the recording paper 6.

In the image forming device according to the invention, where the device body 1 is vertically installed, the moisture absorption sheet 9 arranged between the fixing unit 27 and the process unit including the photosensitive drum 20 absorbs water vapor produced from the recording paper 6 passing through the fixing unit 27.

Particularly, the device body is vertically installed, the chimney effect ascends water vapor toward the process unit. The moisture absorption sheet 9 absorbs the moisture vapor, thus reducing the amount of water vapor in the device body 1. Thus it can be certainly prevented that moisture vapor affects the process unit.

The moisture absorption sheet 9 is effective in the case where the process unit (photosensitive drum 20) is in a cooled state or moisture vapor sweating state before the inside of the device body 1 reaches a constant temperature. When the device body 1 has an internal temperature of a constant value, the fan unit 33 operates to exhaust moisture vapor out of the device unit 1.

According to the present embodiment, the contactless discharger formed of the charger 21 and the transfer unit 26 can perform a stable, uniform charging and transferring operation without sticking toner left on the photosensitive drum 20 onto the unit through no cleanerless process.

(c) Explanation of Developing Unit

Figure 8:
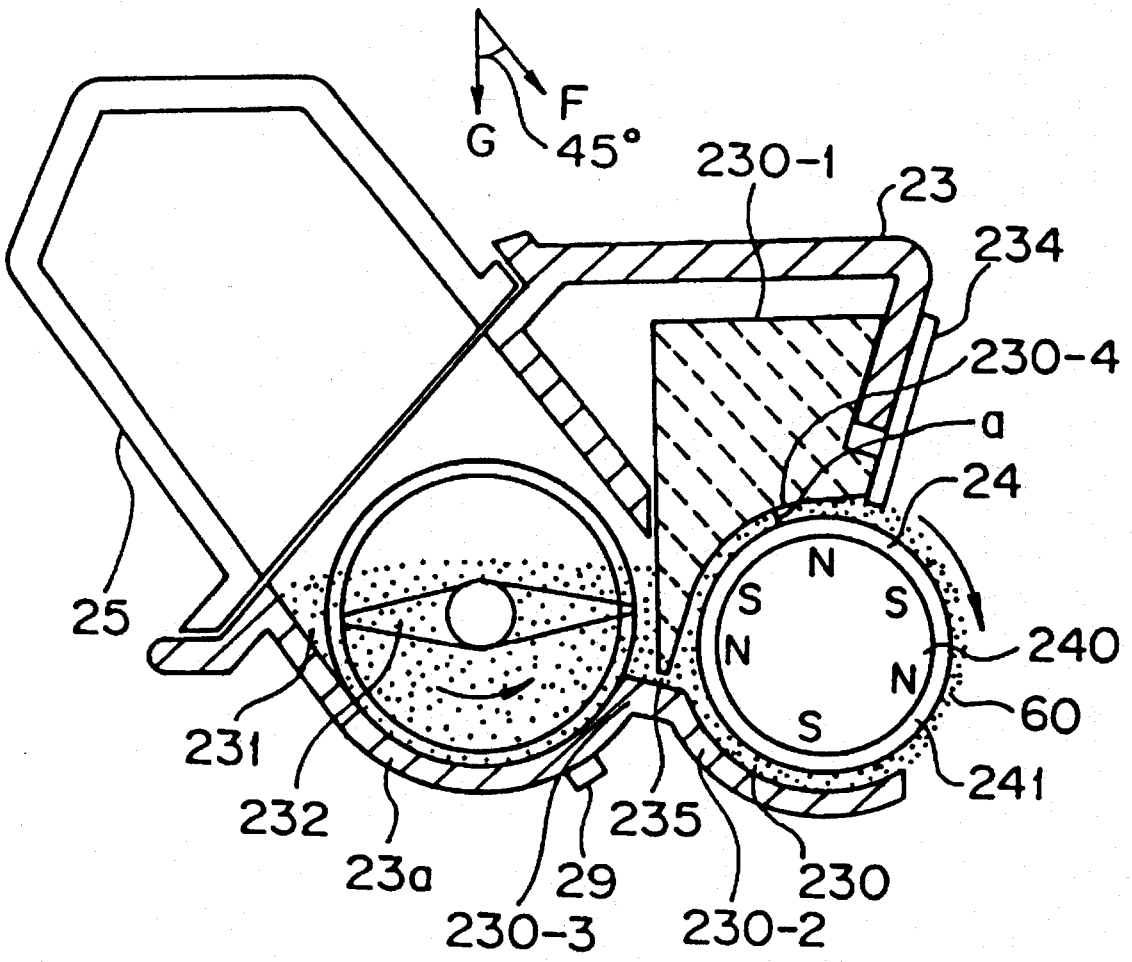
FIG. 8 is a vertical cross sectional view showing the condition of the developing unit horizontally installed.
Figure 9:
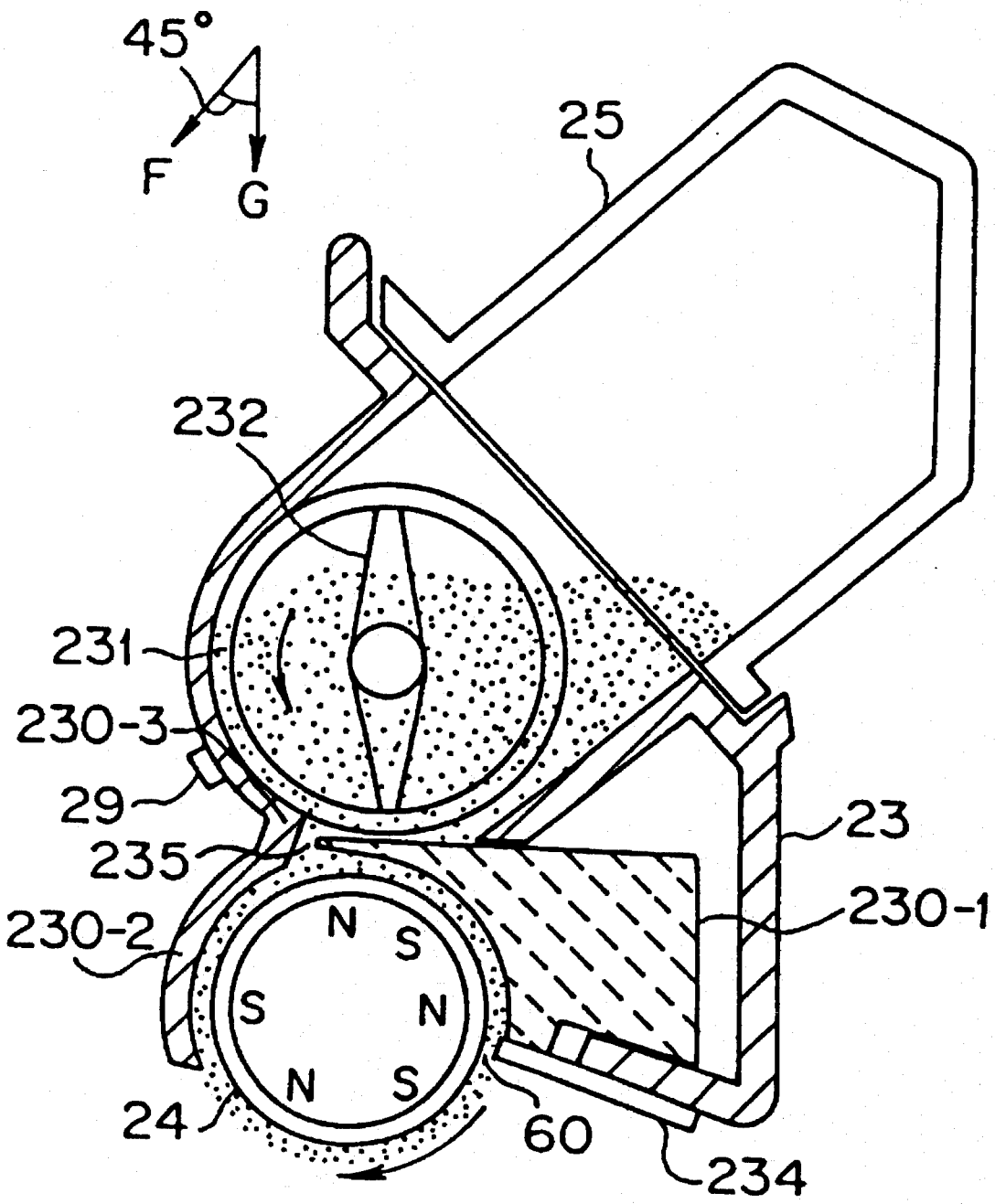
FIG. 9 is a vertical cross sectional view showing the condition of the developing unit vertically installed.

FIG. 8 is a vertical cross-sectional view of the developing unit installed horizontally (refer to FIG. 6). FIG. 9 is a vertical cross-sectional view showing the developing unit vertically installed (refer to FIG. 7).

Referring now to FIGS. 8 and 9, numeral 29 represents a toner sensor mounted securely on the side of the device body 1. The toner sensor 29 generates a voltage output according to the magnetic force of magnetic toner and is formed, for example, of a permeability sensor. The developing unit 23 is mounted detachably and attachably onto the device body 1. The toner sensor 29 detects the presence or absence of the internal magnetic toner (the amount of residual toner) via the case 23*a* of the developing unit 23.

The developing roller 24 is formed of a metal sleeve 241 and a magnet 240 with plural magnetic poles mounted inside the sleeve 241. The developing roller 24 fixes the magnet 240 inside the sleeve 241 to transfer magnetic developer (to be described later) by rotating the sleeve 241. The developing roller 24 with, for example, 16 mm diameter is rotated and driven at a speed (e.g. 75 mm/sec.) three times the peripheral speed of the photosensitive drum 20.

The developing chamber 230 is formed around the developing roller 24. 1.5 component developer being a mixture of magnetic carriers and magnetic toner are filled in the developing chamber 230. The developing chamber 230 is formed of an upper divider member 230-1 and the lower bottom portion 230-2 to have a fixed volume.

Hence, where a fixed amount of magnetic carriers is filled into the developing chamber 230, the amount of the magnetic toner therein is filled. Magnetic toner corresponding to the consumed magnetic toner is refilled out of the toner hopper 231 to maintain the developer in the developing chamber 230 to a fixed amount. Hence this process can eliminate the control of the toner density. In other words, the toner density can be automatically controlled to a desired range by filling the amount of carriers corresponding to the control point of toner density into the developing chamber 230.

Developer is always filled around the developing roller 24 in the developing chamber 230. Hence, even when the developer is placed locally in the developing chamber 230 by vertically installing the device body 1, the case where the developer cannot be supplied enough to the developing roller 24 can be prevented.

As the developer 60 is used a mixture of a magnetite carrier (magnetic carrier) of a grain diameter of, e.g. 40 μm on average and a polymerized toner (magnetic toner) of a grain diameter of, e.g. 7 μm on average manufactured using a polymerizing method. The polymerized toner with uniform grain diameter and sharp-grain distribution provides uniform adhesion between a toner image on the photosensitive drum 20 and the recording paper 6 in the transferring step. For that reason, the uniform electric field on the transferring unit 26 can improve the transfer efficiency, compared with that in the conventional powdering method. The powder toner provides a transfer efficiency of 60 to 90%. However, the polymerized toner can provide a transfer efficiency of 90% or more. In the polymerized toner, the suitable toner density is 5 to 60 wt %, and is set to 25 wt % in the present embodiment.

Numeral 234 represents a doctor blade. The doctor blade 234 adjusts the developing roller 24 to feeds optimally developer onto the electrostatic latent image on the photosensitive drum 20. The adjustment is carried out to the gap between the edge of the doctor blade 234 and the surface of the developing roller 24 to set to 0.1 to 1.0 mm.

Numeral 231 represents a toner hopper filled with only magnetic toner. The supply roller (agitator) 232 is mounted inside the toner hopper 231. The supply roller 232 rotates to feed toner to the developing chamber 230.

The toner fed into the developing chamber 230 is agitated therein by means of the developer carrying force of the sleeve 240 in the developing roller 24, the magnetic force of the developing roller 24, and the developer limiting function of the doctor blade 234. Then friction of the toner and carriers charges to a predetermined magnetism and charge amount. According to the present embodiment, the charged chain between carriers and toner is adjusted to have negatively-charged toner.

The divider member 230-1 sets the gap a (refer to FIG. 8) to the developing roller 24 to a smaller value than the head of the magnetic brush (not shown) formed over the developing roller 24, on the upper stream of the doctor blade 234. Here, the gap a is set to, for example, 2.0 mm. The magnetic brush over the developing roller 24 is regulated by the divider member 230-1 and the magnetic brush is forced by the rotation of the developing chamber 24. For that reason, the developer in the developing chamber 230 is agitated strongly so that the amount of stable toner charge can be obtained over the higher range of toner density.

The inner wall surface of 230-4 of the divider member 230-1 is shaped along the form of the developing roller 24. That is, since the gap a in an arc shape is formed between the developing roller 24 and the inner wall surface 230-4, there is no place where magnetic carriers sojourn. Hence, since all magnetic carriers and magnetic toner are always agitated around the developing roller 24 and then carried, the toner density control value can be prevented from being varied.

Since all magnetic carriers and magnetic toner are agitated, it can be expected that the toner charging amount is stable over a higher range of toner density. In addition, the charging effect does not vary in the horizontal installation or vertical installation of the device body 1.

A toner feeding path 235 formed of the tip of the divider member 230-1 and the bottom portion 230-2 is arranged between the toner hopper 231 and the developing chamber 230. The toner feeding path 235 supplies the toner stored in the toner hopper 231 to the developing chamber 230.

The angle made by the wall surfaces of the toner cartridge 25 and the toner hopper 231 is set at 45° with respect to the gravity direction and the toner flowing direction is set at 45°. This angle setting allows the toner to be smoothly fed even if the device body 1 is vertically installed, to be described later with FIG. 9.

Next, the operation of the developing unit 23 will be explained. FIG. 8 shows the state of the developing unit 23 installed horizontally shown in FIG. 6. As shown in FIG. 8, according to the present embodiment, the angle made by the wall surfaces of the toner cartridge 25 and the toner hopper 231 is set at 45° with respect to the gravity direction. Hence, toner flows toward the bottom of the toner hopper 231, thus being fed smoothly to the supply roller 232.

Thus, only the toner fed with the supply roller 232 is fed into the toner feed path 235 while the divider member 230-1 acts as a buffer. The push force of the supply roller 232 does not affect directly the toner feed path 235. Hence, pushing excessively toner can be prevented but only the amount of toner needed can be fed into the developing chamber 230.

Because of the bottom portion 230-2 tilted upward with respect to the rotational direction of the developing roller 24, carriers which are deviated from the magnetic brush of the developing roller 24 and the magnetic brush after a passage of the portion facing the photosensitive drum 20 do not leak from the toner feed path 235 to the toner supply chamber 231 via the bottom 230-2. As a result, a decrease in starter carriers in the developing chamber 230 can be prevented, whereby 1.5 component development can be stably carried out.

FIG. 9 shows the state of the developing unit 23 installed vertically shown in FIG. 7. As shown in FIG. 9, according to the present embodiment, the angle made by the wall surfaces of the toner cartridge 25 and the toner hopper 231 is set to be at about 45° with respect to the gravity direction even in the vertical installation, whereby toner can be fed smoothly to the supply roller 232.

In order to better carry toner by its own weight, the proper angle made by the wall surfaces of the toner cartridge 25 and the toner hopper 231 is approximately 45°±10°, preferably 45°±5°, with respect to the gravity direction, considering the angle of repose. Thus a better result can be obtained.

As shown in FIG. 9, toner which stays on the side of the toner hopper 231 of the divider member 230-1 drops easily from the toner feed path 235 to the developing chamber 230.

However, the protrusion 230-3 on the bottom portion 230-2 can regulate toner falling toward the toner feed path 235, thus hardly causing a fall of toner. Hence, the toner can be supplied only by the rotation of the supply roller 232.

That is, the toner pushed by the supply roller 232 is once hit against the divider member 230-1 by means of the protrusion 230-3 on the bottom portion 230-2 and then introduced into the toner feed path 235. Thus, only the toner supplied by the supply roller 232 is introduced into the toner feed path 235. The divider member 230-1 acts as a buffer so that the push force of the supply roller 232 does not work directly as the toner supply force. Hence, it is possible to prevent toner from being introduced excessively, but only the necessary amount of toner refilled into the developing unit 230.

As described with FIGS. 8 and 9, the toner supply capability to the developing chamber 230 does not vary even in the horizontal or vertical installation of the device body 1. Hence, the toner density does not vary even in the horizontal or vertical installation, whereby a variation in image density can be prevented.

The vertical installation may drop developer out of the developing unit 23. However, the magnetic two-component developer used as developer is sustained on the developing roller 24 by means of its magnetism so that the developer hardly drops. Particularly, since magnetic carriers and magnetic toner are held by means of the magnet roller of the developing roller 24, a fall of developer can be certainly prevented. As a result, development can be stably performed in the vertical installation.

(d) Control System

Figure 2:
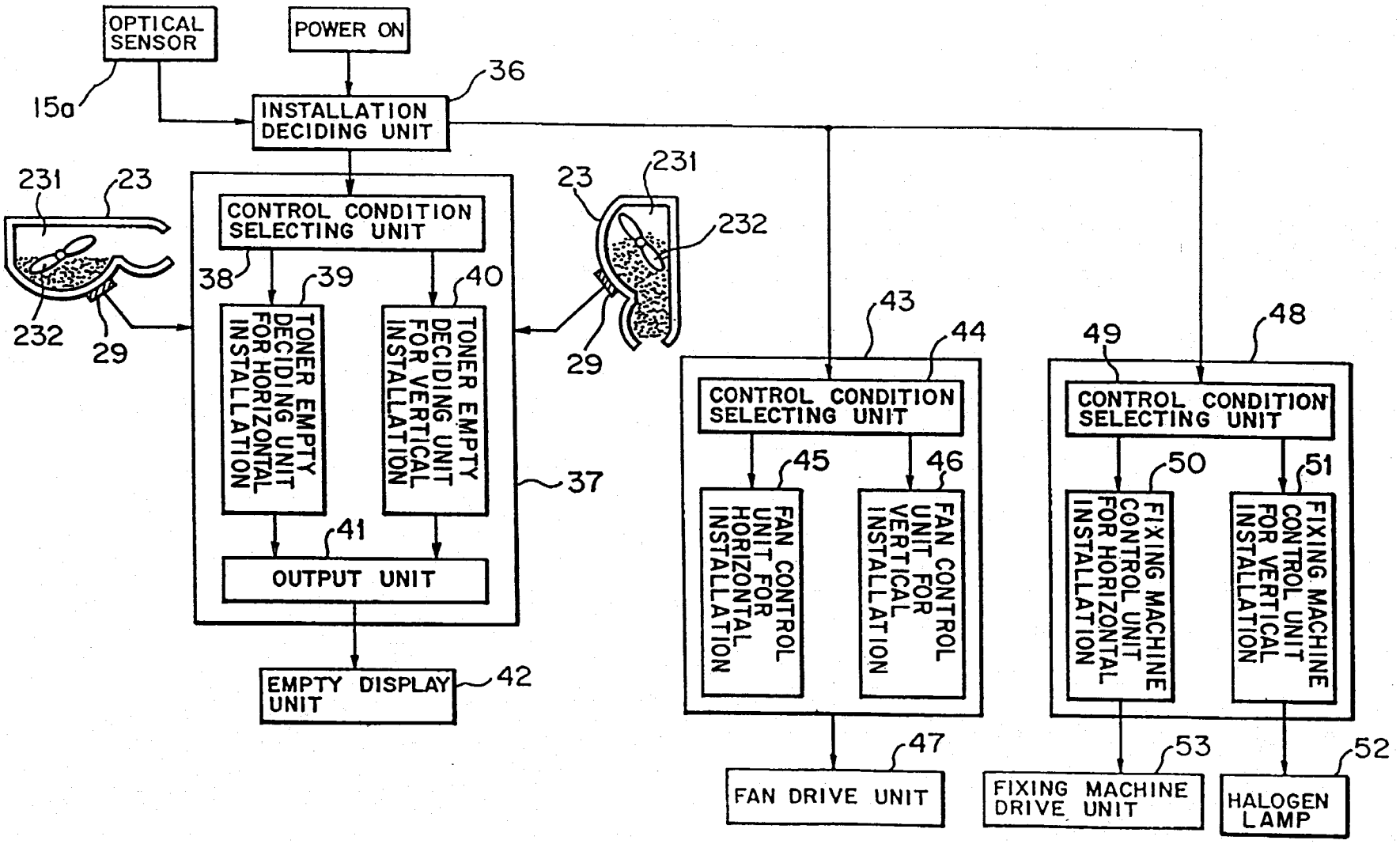
FIG. 2 is a block diagram showing the functional configuration of the control system of an image forming device according to the first embodiment of the present invention.

FIG. 2 is a block diagram functionally showing the configuration of an image forming device according to the first embodiment of the present invention. Referring to FIG. 2, numeral 36 is an installation direction deciding unit that decides the installation direction of the device body 1, based on the output signal from the optical sensor 15*a*, 37 represents an empty control circuit (control unit) that performs a toner empty control according to the installation direction of the device body 1 decided by the installation direction deciding unit 36, based on the output signal from the toner sensor 29.

The empty control circuit 37 consists of a control condition selecting unit 38, a horizontal toner empty state deciding unit (control sequence unit) 39, a vertical toner empty state deciding unit (control sequence unit) 40, and a output unit 41.

The control condition selecting unit 38 selects the toner empty state deciding unit 39 or 40 according to the installation direction from the installation direction deciding unit 36.

When the device body 1 is horizontally installed, the horizontal toner empty state deciding unit 39 is selected by the control condition selecting unit 38. The horizontal toner empty state deciding unit 39 decides the toner empty state by comparing the level of each output signal sampled in one detection period during which the output signal from the toner sensor 29 are sampled several times, with the horizontal slice level obtained by calculating the average value of outputs sampled in the previous detection period. The detailed operation will be described later by referring to FIGS. 11 to 14.

The vertical toner empty state deciding unit 40 is selected by the control condition selecting unit 38 when the device unit 1 is installed vertically. The vertical toner empty state deciding unit 40 decides the empty state by comparing the level of each output signal sampled in one detection period during which the output from the toner sensor 29 is sampled a predetermined number of times, with the vertical slice level calculated by applying the maximum value and the minimum value of the output signals sampled in the previous detection period to the formula [(maximum value−minimum value)×*k*+minimum value, where k is e.g. 0.3]. The operation will be described later in detail by referring to FIGS. 11 to 14.

The output unit 41 receives the detection result from the empty state deciding unit 39 or 40, and then outputs a releasing decision in addition to an empty decision or a near empty decision. Numeral 42 represents an empty state display unit (toner empty indicator) arranged on the operation panel 5 of the device body 1.

Numeral 43 represents a fan control circuit (control unit). The fan control circuit 43 controls the operational condition of the fan unit 33 according to the installation direction of the device body 1. The fan control circuit 43 consists of a control condition selecting unit 44, a horizontal fan control unit (control sequence unit) 45 and the vertical fan control unit (control sequence unit) 46.

The control condition selecting unit 44 selects the fan control unit 45 or 46 according to the installation direction from the installation direction deciding unit 36.

Where the device body 1 is horizontally installed and the fixing unit 27 is arranged nearly in parallel to the process unit including the photosensitive drum 20, the horizontal fan control unit 45 is selected by the control condition selecting unit 44. Where the device body 1 is vertically selected and the process unit is arranged above the fixing unit 27, the vertical fan control unit 46 is selected by the control condition selecting unit 44.

The operation of the fan control units 45 and 46 will be described later in detail with reference to FIGS. 15 to 17.

Numeral 47 represents a fan drive unit (motor or the like) that drives actually the fan unit 33 in response to the control signal from the fan control unit 45 or 46.

Numeral 48 represents a fixing unit control circuit (control unit). The fixing unit control circuit 48 controls the operational condition of the fixing unit 27 according to the installation direction of the device body 1. The fixing unit control circuit 48 consists of a control condition selecting unit 49, a horizontal fixing unit control unit (control sequence unit) 50, and a vertical fixing unit control unit (control sequence unit) 51.

The control condition selecting unit 49 selects the fixing unit control unit 50 or 51 according to the installation direction from the installation direction deciding unit 36.

Where the device body 1 is horizontally installed and the fixing unit 27 is arranged nearly in parallel to the process unit including the photosensitive drum 20, the horizontal fixing unit control unit 50 is selected by the control condition selecting unit 49. Where the device body 1 is vertically installed and the process unit is arranged above the fixing unit 27, the vertical fixing unit control unit 51 is selected by the control condition selecting unit 49.

The operation of the fixing unit control units 50 and 51 will be described later in detail by referring to FIGS. 18 to 22.

Numeral 52 represents a Halogen lamp (heater) which is actually controlled in its temperature in response to the control signal from the fixing unit control unit 50 or 51. Numeral 53 represents a fixing unit drive unit (such as a motor) which rotatably drives actually the heater roller and the pressure roller in the fixing unit 27, in response to the control signal from the fixing unit control unit 50 or 51.

(e) Toner Empty Detecting Method

The configuration of the image forming device according to the present embodiment shown in FIGS. 3 to 9 is designed in such a manner that the amount of toner supplied from the toner hopper 231 to the developing roller 24 does not vary even in the horizontal installation or vertical installation. However, the toner detection condition to the toner sensor (permeability) 29 differs in the horizontal installation or the vertical installation.

In comparison of the horizontal installation shown in FIG. 8 and the vertical installation shown in FIG. 9, in the case of the horizontal installation, toner stays on the bottom of the toner hopper 231 while the toner supply is being sequentially continued. Thus the toner sensor (permeability sensor) 29 detects the condition of the detention toner decreasing on the bottom. On the other hand, in the vertical installation, toner stays with the distribution scattered toward the divider member 230-1 within the toner hopper 231 while the toner supply is sequentially continued. The toner sensor 29 detects the scattered detention toner. Such a difference becomes large as the amount of retention toner decreases. As a result, the toner empty detection is unstable in the vertical installation.

In the image forming device according to the present invention, when power is switched on, the installation direction deciding unit 36 receives the output signal from the optical sensor 15*a* to decide whether the device body 1 is in the horizontal installation or vertical installation. In the case of the horizontal installation of the device body 1, the fact is informed the control condition selecting unit 38 in the empty control circuit 37. Then the control condition selecting unit 38 selects the horizontal toner empty state deciding unit 39.

The horizontal toner empty state deciding unit 39 monitors the output state of the toner sensor 29 according to the control sequence; decides as an empty or near empty the output state less than a predetermined condition (to be described later); and reports the display unit 42 of the decision result through the output unit 41. When the deciding unit 39 decides that the output state of the toner sensor 29 is more than a predetermined condition because of refilling toner by an operator, it decides releasing an empty or near empty condition and then releases the reporting state through the output unit 41.

Similarly, in the device body 1 vertically installed, the control condition selecting unit 38 selects the vertical toner empty state deciding unit 40 according to the output signal from the optical sensor 15*a*. The deciding unit 40 monitors the output state of the toner sensor 29 according to the control sequence; decides as an empty or near empty condition when the output is less than a predetermined condition (to be described later); and reports the display unit 42 of the decision result through the output unit 41. When the deciding unit 40 decides that the output state of the toner sensor 29 is more than a predetermined condition because of refilling toner by an operator, it decides releasing an empty or near empty condition and then releases the reporting state through the output unit 41.

Figure 10:
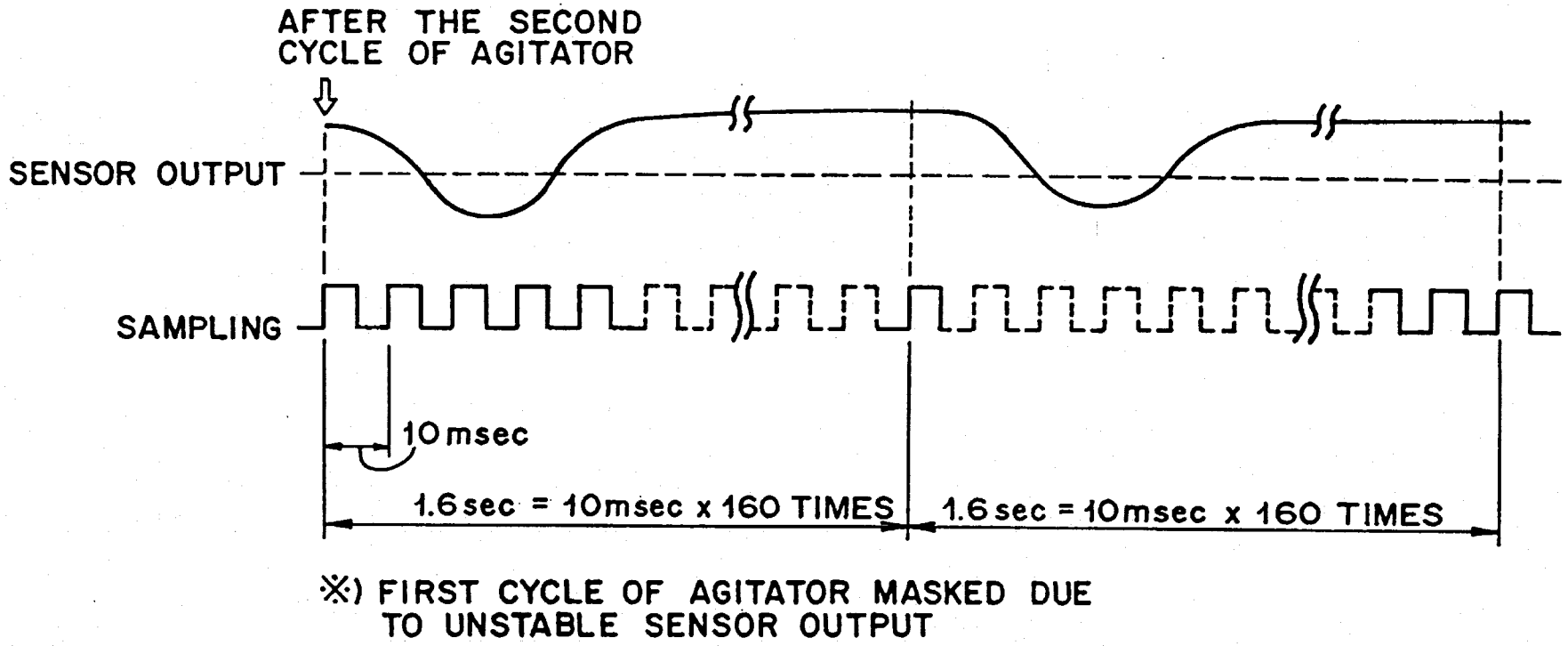
FIG. 10 is a diagram explaining the toner empty detection operation of the present embodiment.

The operation of the empty detection of the deciding units 39 and 40 will be described with reference to FIG. 10. First, let us explain the empty detection operation of the horizontal toner empty state deciding unit 39. In the present embodiment, with the supply roller (agitator) 232 rotating at 1.6 seconds per revolution, the detection period of the toner sensor 29 is set to 1.6 seconds. The output voltage from the toner sensor 29 is sampled every 10 milliseconds for 1.6 seconds, as shown in FIG. 10. Sampling is performed 160 times during one detection period and then 160 output voltage data are obtained.

The deciding unit 39 calculates an average value of the output voltages (160 detection data) during the previous detection period as a slice level for the current detection period and then counts the number of sampling in which the slice level is less than the average value of the previous detection period, among the 160 sampling operations. When the detection period during which the number of sampling is more than, for example, 80 during one detection period is detected, the deciding unit 39 decides the condition as a near empty, thus controlling the display unit 42 to display the decision through the output unit 41.

When an operator refills toner according to the near empty display, the toner sensor 29 rises its output voltage. Of 160 sampling operations, when the decision unit 39 decides that the number of sampling in which the sampled level is less than the average value of output voltages during the previous detection period is less than, for example, 70, it clears the near empty display on the display unit 42 through the output unit 41.

When it is detected that the number of sampling in which the sampled level is less than the average value of the output voltages during the previous detection period, without refilling toner after the near empty display, is more than, for example, 90, the deciding unit 39 decides the condition as a toner empty, thus controlling the display unit 42 to display the condition through the output unit 41.

When an operator refills toner after the empty display, the toner sensor 29 boosts its output voltage. Of 160 sampling operations, the deciding unit 39 decides that the number of sampling in which the sampled level is less than the average value of the output voltages during the previous detection period, for example, 70, it clears the empty display on the display unit 42 through the output unit 41.

Next the empty detection operation of the vertical toner empty state deciding unit 40 will be described below. According to the present embodiment, the deciding unit 40 calculates the slice level for the current detection period by applying the formula [(Max−Min)×0.3+Min], where Max is the maximum value of the output voltages (160 detection data) during the previous detection period and Min is the minimum value of the output voltages (160 detection data) during the previous detection period, and then counts the number of samplings in which the average voltage is less than the slice level, of 160 samplings. When the detection period in which the number of sampling during one detection period is more than, for example, 70 is detected, the deciding unit 40 decides the condition as a near empty, thus controlling the display unit 42 to display it through the output unit 41.

When an operator refills toner according to the near empty display, the toner sensor 29 boosts its output voltage. Of 160 sampling operations, the deciding unit 40 decides that the number of sampling in which the output voltage is more than the slice level calculated based on the output voltages during the previous detection period is more than, for example, 90, the near empty display on the display unit 42 is cleared through the output unit 41.

Where the toner empty detection is carried out in one detection period as one rotation of the supply roller (agitator) 232, the output voltage of the toner sensor 29 is unstable at the first rotation at which the supply roller 232 begins to rotate, because of the unstable flow of toner. Hence, to prevent an erroneous detection, the toner empty detection is not carded out by masking the sensor output during the first rotation of the supply roller 232. The slice level is calculated, based on the output voltage of the toner sensor 29 obtained at the second rotation of the supply roller 232. In actual, the toner empty detection starts at the third rotation of the supply roller 232.

The timing at which the optical sensor 15*a* detects the installation direction of the device body 1 is, for example, a warm-up time after power-on time, an initialization time when the paper ejection tray is opened or shut, a time after the main motor has started to rotate for printing operation, or the like. The output from the optical sensor 15*a* is read at the detection timing and then the installation direction deciding unit 36 decides the installation direction. Because the optical path is cut as shown with the solid lines in FIG. 5, the optical sensor 15*a* produces a high output in the horizontal installation. The optical sensor 15*a* produces a low output in the vertical installation, because of the optical path opened as shown with the dotted lines in FIG. 5.

The toner empty state deciding unit 39 or 40 performs always an empty detection during the rotation of the main motor (during the printing operation), except the warm-up operation after a power-on time and the initializing operation when the paper ejection tray is opened or shut.

When the toner empty state deciding unit 39 or 40 detects a near empty, it flashes, for example, the empty state display unit 42. In such a state, when the paper ejection tray is opened or shut, or the power supply is switched on or off, the near empty is released if the sensor output reaches a toner empty releasing level at the initializing time (the display unit 42 turned off; the device in ready state). If the output does not reach the releasing level, the display 42 flashes continuously. The near empty is memorized even in power-off state.

Similarly, when the toner empty state deciding unit 39 or 40 detects a toner empty, the empty state display unit 42 is flashed. The device is stopped after a job completion (Not Ready state). In this state, when the paper ejection tray is opened or shut or the power supply is switched on or off, the toner empty is released (the display unit 42 turned off; the device in Ready state) if the output reaches the toner empty releasing level at the initializing time. If the output does not reach the releasing level, the display unit 42 flashes continuously. The toner empty is memorized even in the power off state.

Figure 11:
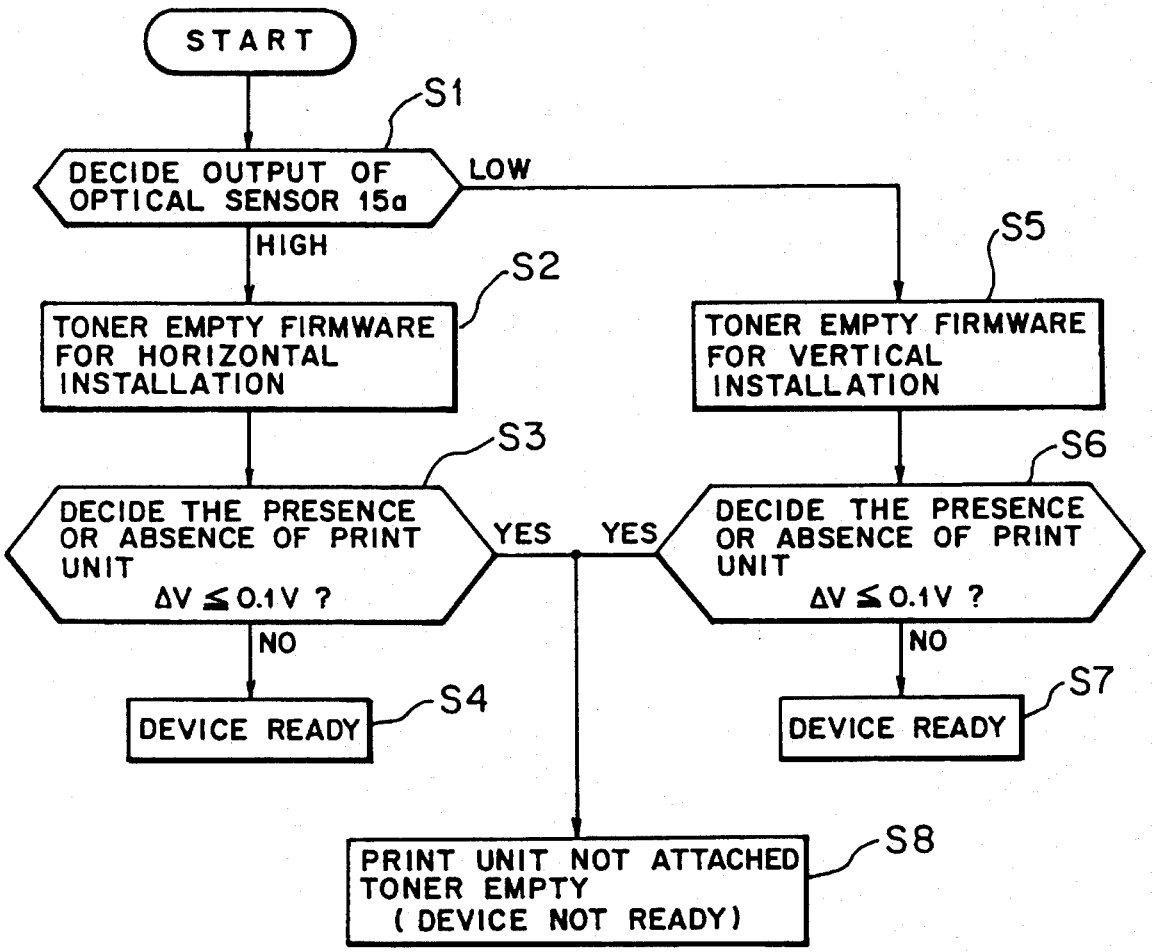
FIG. 11 is a flowchart explaining the toner empty control operation of the present embodiment.

Next, the empty control operation of the image forming device according to the present embodiment will be described below by referring to the FIGS. 11 to 14. FIG. 11 shows the image forming device which operates at power-on time, non-toner empty time, and a time the paper ejection tray is opened or shut. First, the installation direction deciding unit 36 decides the installation direction of the device body 1, based on the output signal in a high or low state from the optical sensor 15*a* (step S1).

When the output signal from the optical sensor 15*a* is in a high level, the control condition selecting unit 38 selects the horizontal toner empty state deciding unit 39 (step S2). Then the presence or absence of the print unit is decided based on the output voltage ΔV from the toner sensor 29 (step S3).

When the output voltage ΔV from the toner sensor 29 is less than 0.1 volts, the condition is decided as the print unit not attached or a toner empty. The device is in Not Ready state (step S8). When the output voltage ΔV from the toner sensor 29 is more than 0.1 volts (with the print unit attached), the device is in Ready state (step S4).

When it is decided that the optical sensor 15*a* produces an output signal of a low level in the step S1, the control condition selecting unit 38 selects the vertical toner empty state deciding unit 40 (step S5). Then like the step S3, the presence or absence of the print unit is decided based on the output voltage ΔV from the toner sensor 29 (step S6).

When the output voltage ΔV from the toner sensor 29 is less than 0.1 volts, the condition is decided as no print unit attached or toner empty so that the device is in Not Ready state (step S8). When the output voltage ΔV from the toner sensor 29 is more than 0.1 volts, the device is in Ready state (step S7).

Figure 12:
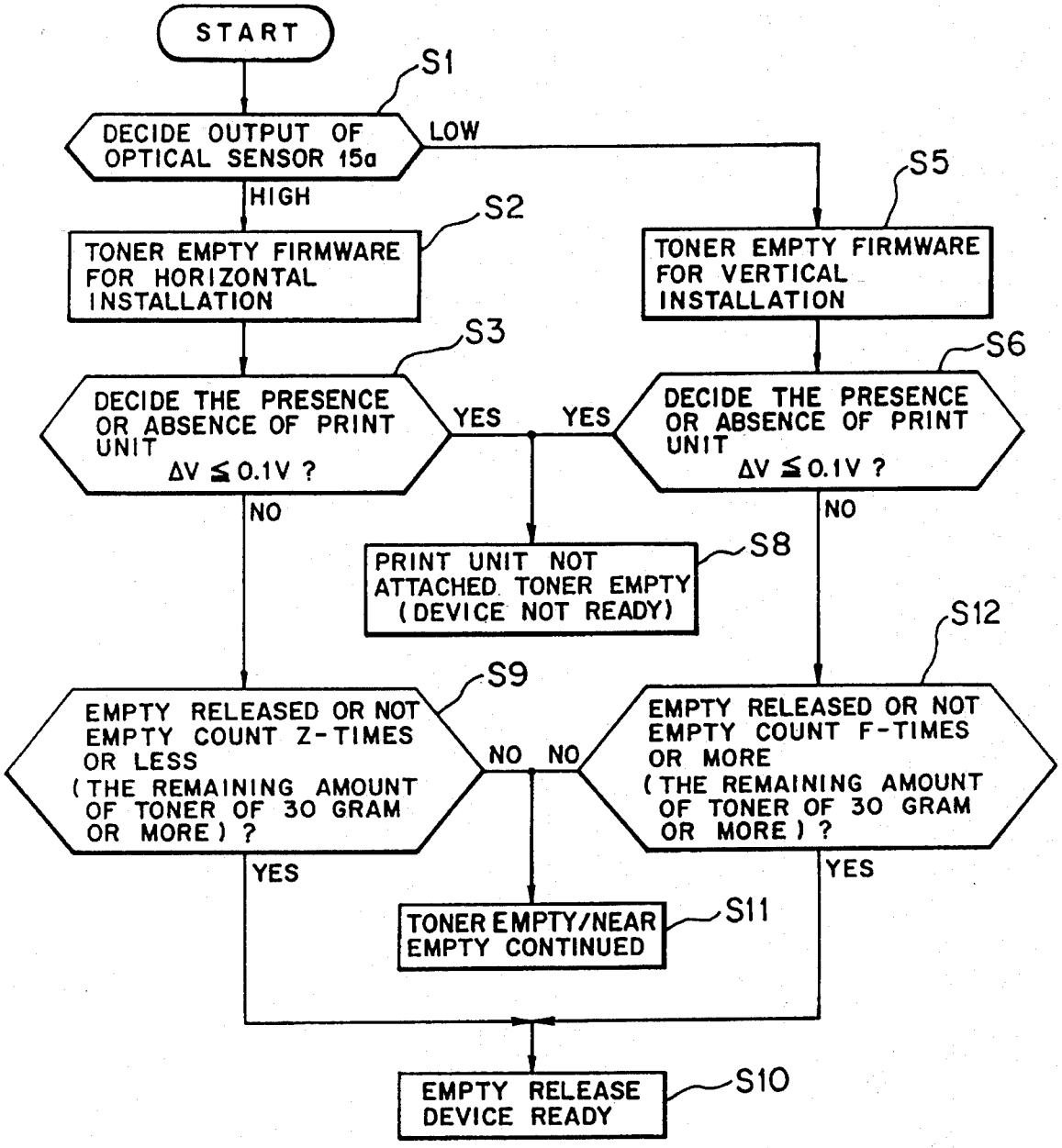
FIG. 12 is a flowchart explaining the toner empty control operation of the present embodiment.

FIG. 12 shows the operation of the image forming device at a power-on time, a paper ejection opening or closing time, and a toner empty (or near empty) time. The steps S1 to S3 and S5, S6, and S8 are the same those shown in FIG. 11. The duplicate is omitted here.

With the horizontal toner empty state deciding unit 39 selected, when it is decided that the output voltage ΔV from the toner sensor 29 in the step S3 is more than 0.1 volts (or when the print unit is attached), it is decided whether the empty can be released (step S9).

In other words, it is decided whether the number of sampling (empty count value) in which the output is less than a slice level during one detection period is less than Z (e.g. 70; the remaining toner of more than 30 g). If less than Z, it is decided that toner refilling (toner cartridge change) has been completed. Thus the device is set to the Ready state by an empty releasing operation (step S10). In contrast, if more than Z, it is decided that the toner refilling has not completed. Then the toner empty or near empty state is continued (step S11).

With the vertical toner empty state deciding unit 40 selected, where it is judged that the output voltage ΔV from the toner sensor 29 is larger than 0.1 volts in the step S3 (or when the print unit is attached), it is decided whether the empty can be released (step S12).

At this time, it is decided whether the detection output voltages more than the slice level during one detection period have been continuously sampled F times (e.g. 90; the amount of remaining toner of 30 g or more). If the sampling has been continued F times or more, it is decided that the toner refilling (toner cartridge replacement) has been completed. Thus the empty release makes the device in its Ready state (step S10). If the sampling has not been continued F times or more, it is decided that toner has not been still refilled. Then the toner empty or near empty state continues (step S11).

Figure 13:
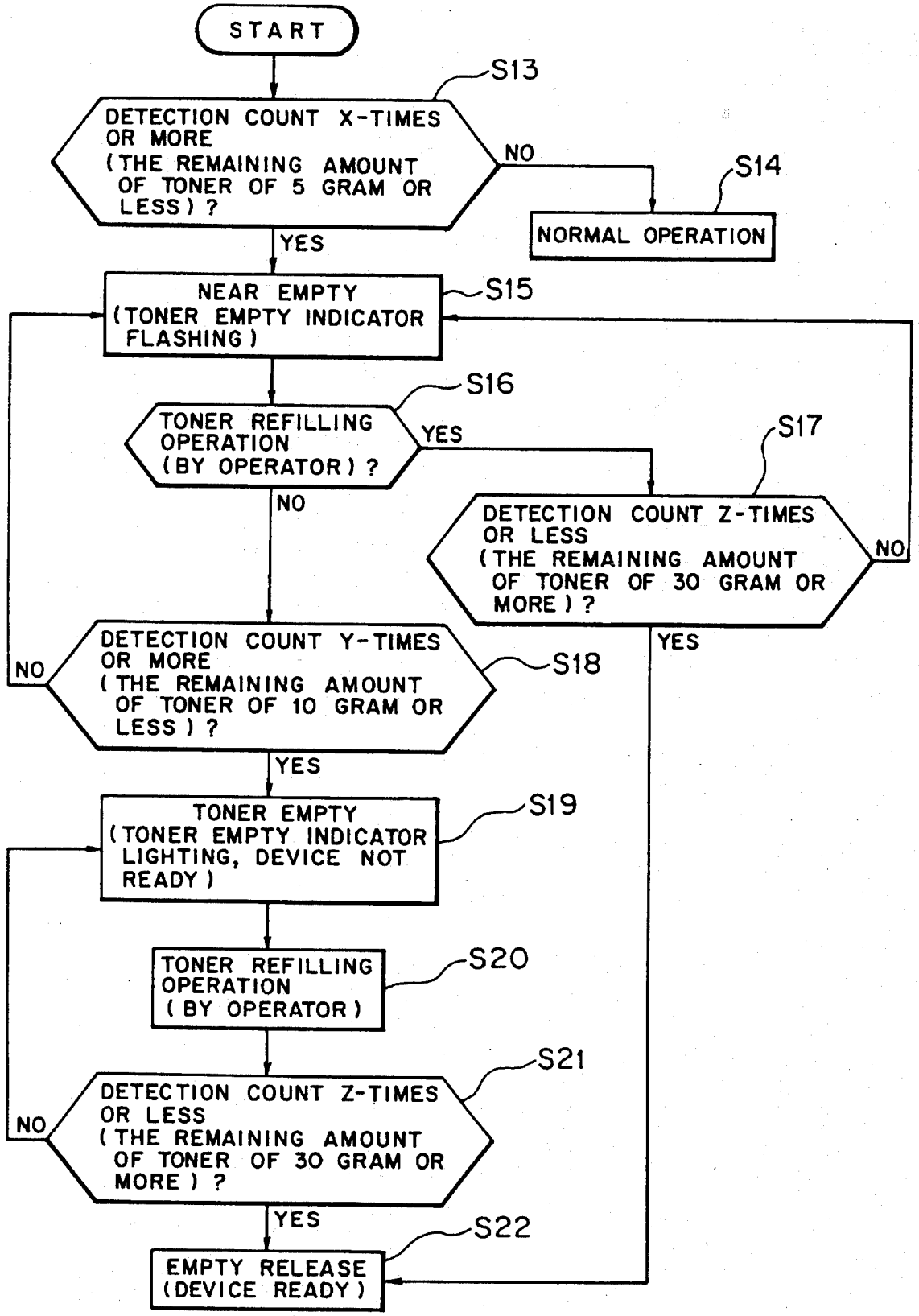
FIG. 13 is a flowchart explaining the toner empty control operation of the present embodiment.

The operation with the horizontal toner empty state deciding unit 39 selected will be described with reference to FIG. 13. First, it is decided whether the number of sampling (or detection count value) in which the output voltage is less than the slice level during one detection period is more than X (e.g. 80; the amount of the remaining toner of 15 g or more) (step S13). If the number is less than X, the normal operation is continued (step S14). If the number is X times or more, the near empty decision is output. Thus the empty state display unit 42 flashes to report an operator of the fact (step S15).

Thereafter, it is decided whether the operator has refilled toner (step S16). If the toner refilling has been completed, it is decided whether the detection count value is Z times or less (e.g. 70; the amount of the remaining toner of 30 g or more) (step S17). If more than Z, the flow goes back to the step S15 to continue the near empty display. If Z times or less, it is decided that the toner refilling has been completed so that the empty state is released to set the device in a ready state (step S22).

If it is decided that toner has not been refilled in the step S16, it is decided that the detection count value is more than Y times (e.g. 90; the amount of the remaining toner of 10 g or less) (step S18). If less than Y, the flow goes back to the step S15 to continue the near empty display (step S18). If Y times or more, the toner empty decision is output to flash the empty state display unit 42. Thus the toner empty is reported an operator while the device is set in Not Ready state (step S19).

When the operator refills toner in response to the toner empty report (step S20), it is decided whether the detection count value is Z times or less (e.g. 70; the amount of the remaining toner of 30 g or more), like the step S17, (step S21). If more than Z, the toner empty display is continued. If Z times or less, it is decided that toner has been refilled so that the empty state is released to set the device in Ready state (step S22).

Figure 14:
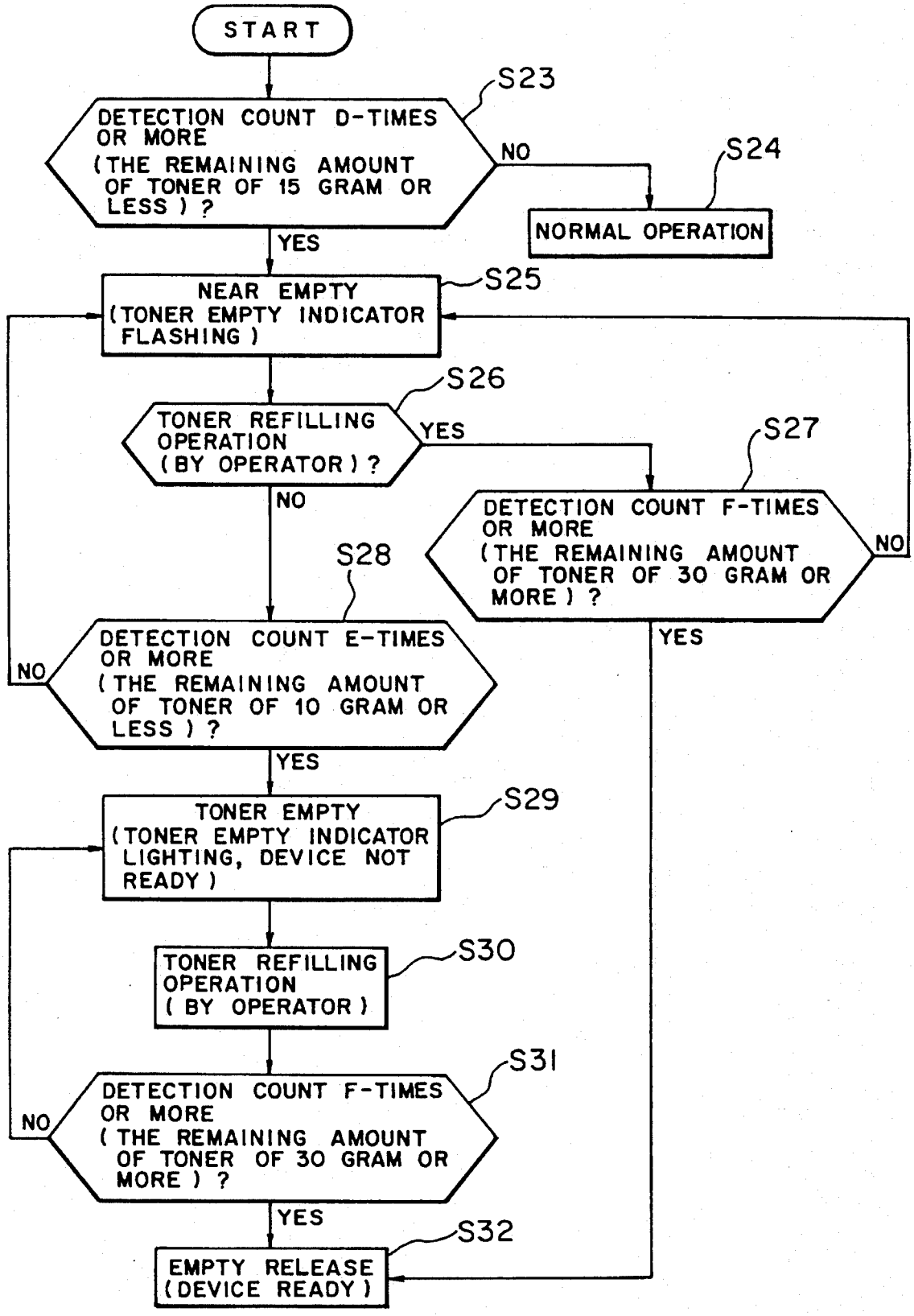
FIG. 14 is a flowchart explaining the toner empty control operation of the present embodiment.

Next, explanation will be made below as to the operation in the case where the vertical toner empty state deciding unit 40 is selected. FIGS. 13 and 14 show steps nearly similar to the above-mentioned steps, but the reference number compared with count values is different. The steps S23 to S32 shown in FIG. 14 correspond the steps S13 to S22 shown in FIG. 13, respectively.

First, it is decided whether the output voltages being less than the slice value have been continuously sampled during one detection period D times or more (e.g. 80; the amount of the remaining toner of 15 g or less) (step S23). If less than D, the normal operation is continued (step S24). If D times or more, the near empty decision is output. Thus, the empty state display unit 42 is flashed to report the operator of the fact (step S25).

Thereafter, it is decided whether the operator has refilled toner (step S26). If toner has been refilled, it is decided whether output voltages being more than the slice level have been continuously sampled F times or more (e.g. 90; the amount of the remaining toner of 30 g or more) during one detection period (step S27). If not continued F times or more, the flow goes back to the step S25 to continue the near empty display. If continued F times or more, it has been decided that the toner has been refilled, whereby the toner empty is released to set the device in Ready state (step S32).

If it is decided that the toner refilling has not been completed in the step S26, it is decided whether output voltages less than the slice level have been continuously sampled during one detection period E times or more (e.g. 90; the amount of the remaining toner of 10 g or less) (step S28). If less than E times, the flow goes back to the step S25 to continue the near empty display. If E times or more, the toner empty decision is output to flash the empty state display unit 42. Thus the toner empty is reported the operator while the device is set in Not Ready state (step S29).

When the operator refills toner in response to the toner empty report (step S30), it is decided whether output voltages being the slice level or more have been continuously sampled during one detection period F times (e.g. 90; the amount of the remaining toner of 30 g or more), like the step S27, (step S31). If not continued more than F times, the flow goes back to the step S25 to continue the near empty display. If continued F times or more, it is decided that the toner refilling has been completed. Thus the near empty state is released while the device is set in Ready state (step S32).

(f) Fan Control

According to the present embodiment, in the horizontal installation shown in FIG. 8, the process unit such as photosensitive drum 20 is arranged nearly in parallel to the fixing unit 27. In the vertical installation shown in FIG. 9, the process unit is positioned above the fixing unit 27.

The moisture contained in the recording paper 6 is vaporized after passing through the fixing unit 27. Where the temperature of the process unit is, for example, low, the vapor may sweat and appear as drops of water. Particularly, drops of water produced on the photosensitive drum 20 accelerates the degradation of the photosensitive drum 20, thus shortening its operational life.

In the case of the vertical installation, the chimney effect particularly ascends vapor to convert into drops of water which tends to stick easily on the process unit. The process unit is susceptible to the drops of water.

In the image forming device according to the present embodiment, when power is switched on, the installation direction deciding unit 36 receives the output signal from the optical sensor 15*a* and then decides whether the device body 1 is in the vertical or horizontal installation. If the device body 1, for example, is horizontally installed, the fact is reported the control condition selecting unit 44 in the fan control circuit 43. Then the control condition selecting unit 44 selects the horizontal fan control unit 45.

The horizontal fan control unit 45 controls the fan drive unit 47 according to its control sequence to rotate the fan in the fan unit 33 immediately after power is switched on.

When being selected by the control condition selection unit 44, the vertical fan control unit 46 controls the fan drive unit 47 to rotate the fan when a predetermined period of time has been passed after, for example, the power-on operation. Thus, since the fan does not start rotating for a predetermined time after the power-on operation, the temperature of the process unit such as the photosensitive drum 20 increases as the temperature of the fixing unit 27 rises.

The vertical fan control unit 46 drives rotatably the fan when the recording paper 6 is conveyed to the fixing unit 27 and its end is detected with the optical sensor 35. Thus the fan unit 33 exhausts the moisture vapor generated from the recording paper 6 through the vent 34. Part of the moisture vapor ascends to the process unit. However, as described above, according to the present embodiment, heating the process unit for a predetermined period of time during which the fan is not driven makes it difficult to sweat, whereby the device is not affected due to moisture.

When the optical sensor 35 does not detect the end of the recording paper 6 after the predetermined time, the vertical fan control unit 46 drives rotatably the fan after the predetermined time. The vertical fan control unit 46 also drives rotatably the fan even when the optical sensor 35 detects the end of the recording paper 6 in a shorter time than the predetermined time.

Next, the fan control operation of the fan control units 45 and 46 will be described in concrete according to the present embodiment, by referring to FIGS. 15 to 17.

Figure 15:
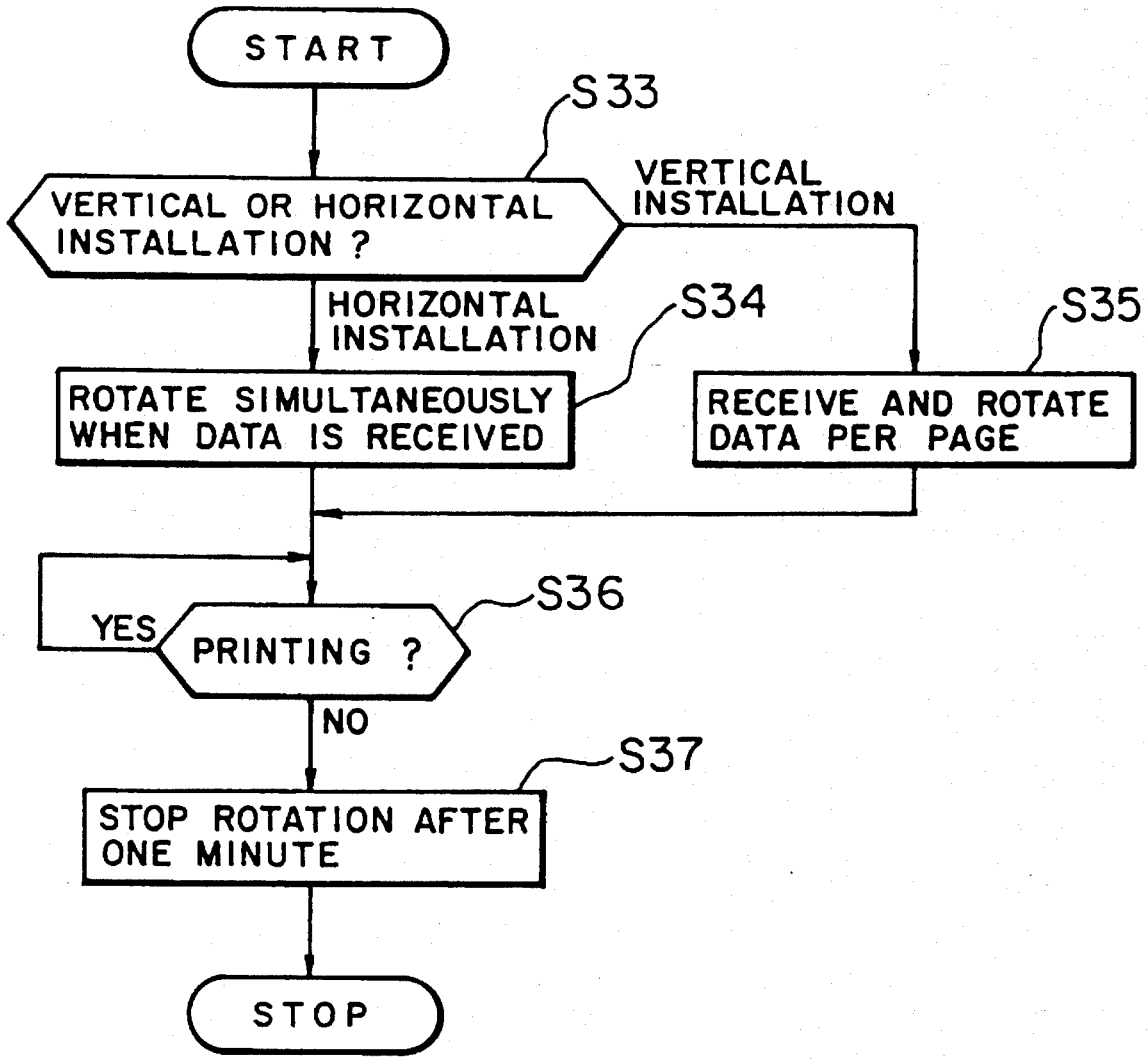
FIG. 15 is a flowchart explaining the fan control operation of the present embodiment.

FIG. 15 shows that the fan of the fan unit 33 starts rotating at different timing, according to the horizontal installation or vertical installation of the device body 1. In other words, the installation direction deciding unit 36 decides the installation direction of the device body 1, based on the output signal from the optical sensor 15*a* (step S33).

When the device body 1 is horizontally installed, the control condition selecting unit 44 selects the horizontal fan control unit 45 to receive data for image formation. At the same time, the fan drive unit 47 rotates and drives the fan in the fan unit 33 (step S34).

When the device body 1 is vertically installed, the control condition selecting unit 44 selects the vertical fan control unit 46. Then the fan drive unit 47 rotatably drives the fan in the fan unit 33 after a reception of data for one page (step S35).

That is, the horizontal fan control unit 45 drives the fan at a predetermined timing for the horizontal installation when power is switched on. The vertical fan control unit 46 drives the fan at a drive timing for vertical installation later than the drive timing for horizontal installation when power is switched on.

Hence, in the case of the vertical installation, since the fan does not rotate until data for one page have been completely received after a power-on operation, the temperature of the process unit such as the photosensitive drum 20 rises as the temperature of the fixing unit 27 rises.

The printing operation or non-printing operation is always monitored (step S36). After the completion of the printing, the fan stops its rotation after one minute has further passed (step S37).

Figure 16:
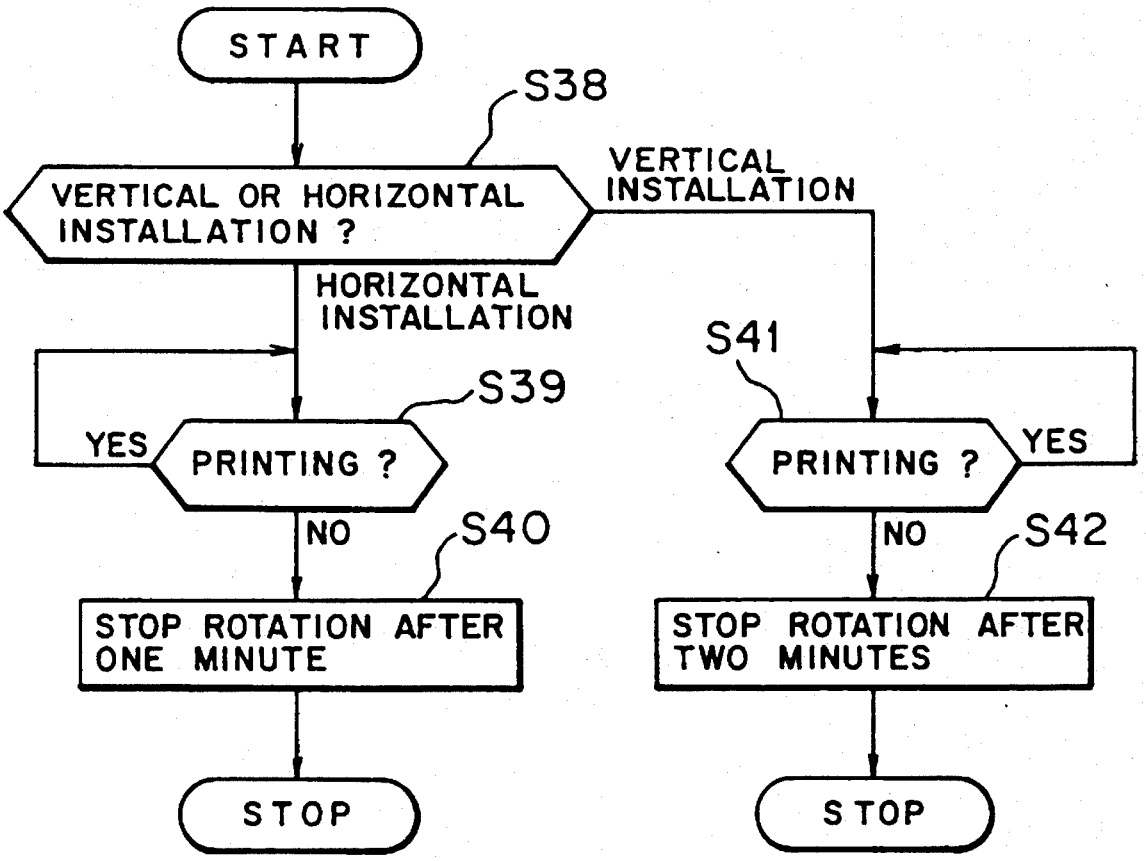
FIG. 16 is a flowchart explaining the fan control operation of the present embodiment.

FIG. 16 shows the case where the fan in the fan unit 33 stops rotating at different timing according to the horizontal installation or the vertical installation of the device unit 1. In other words, the installation direction deciding unit 36 decides the installation direction of the device body 1, based on the output signal from the optical sensor 15*a* (step S38).

In the case of the device body 1 horizontally installed, the control condition selecting unit 44 selects the horizontal fan control unit 45. When one minute has passed after the completion of the printing operation (NO decision in the step S39), the rotation of the fan is stopped (step S40).

In the case of the device body 1 vertically installed, the control condition selecting unit 44 selects the vertical fan control unit 46. When two minutes has passed after the completion of the printing operation (NO decision in the step S41), the rotation of the fan is stopped (step S43).

In other words, the horizontal fan control unit 45 stops the fan at a predetermined stop timing for the horizontal installation after the completion of the printing operation while the vertical fan control unit 46 stops the fan at a stop timing for the vertical installation later than the stop timing for the horizontal timing after the completion of the printing operation.

With the device body 1 vertically installed, heat tends to be stagnate in the process unit due to the temperature rise of the fixing unit 27 after the completion of the printing operation so that overshoot of temperature after the printing operation may melt toner. However, according to the present embodiment, with the device body 1 vertically installed, the temperature rise after the printing operation can be suppressed by continuing the rotation of the fan for a longer period of time than that in the horizontal installation after printing operation so that the effect to the process unit due to temperature unit can be suppressed.

Figure 17:
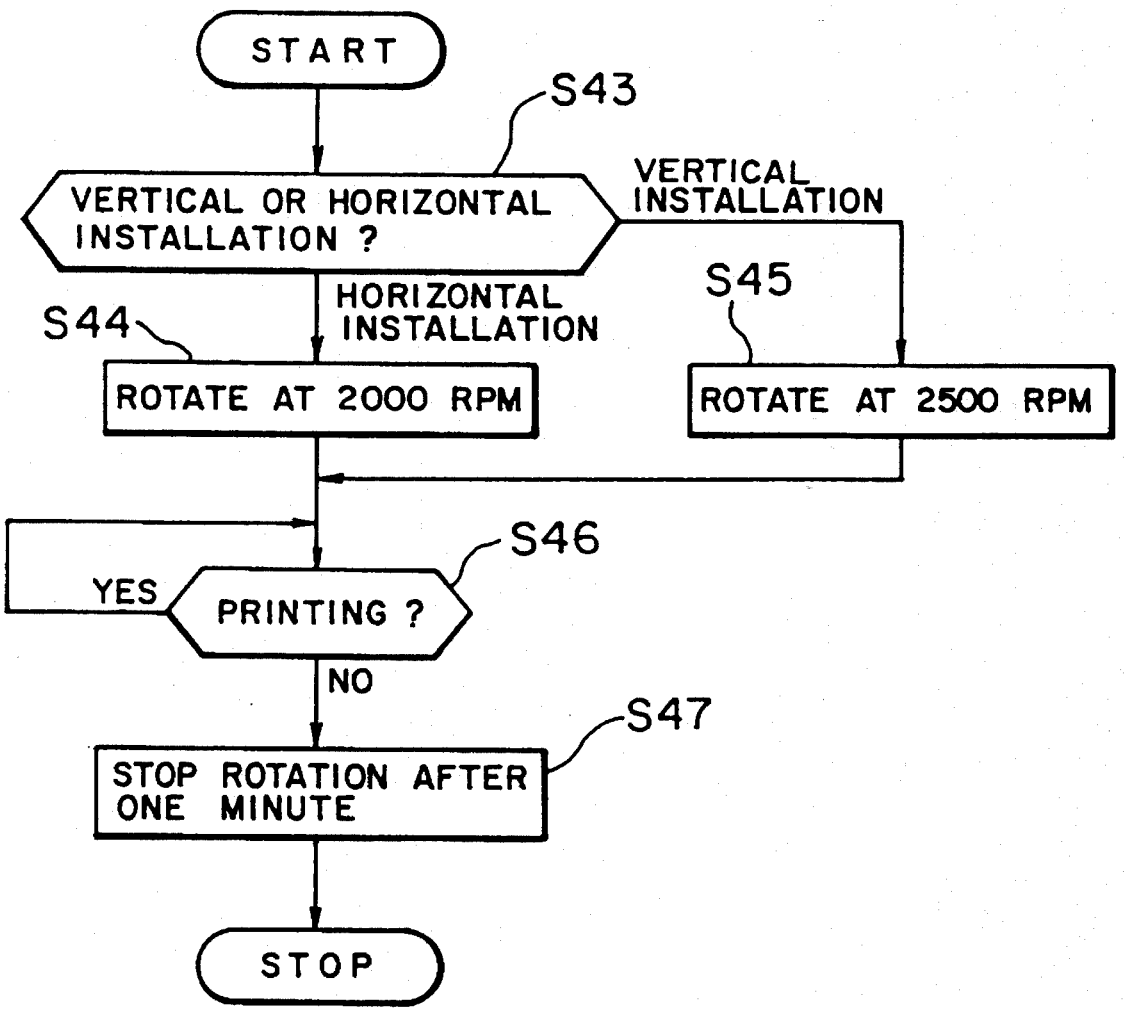
FIG. 17 is a flowchart explaining the fan control operation of the present embodiment.

FIG. 17 shows the case where the fan in the fan unit 33 is driven rotatably at a different timing according to the horizontal or vertical installation of the device body 1. Namely, the installation direction deciding unit 36 first decides the installation direction according to the output signal from the optical sensor 15*a* (step S43).

When the device body 1 is horizontally installed, the control condition selecting unit 44 selects the horizontal fan control unit 45. Then the fan drive unit 47 drives rotatably the fan at, for example, 2000 rpm (step S44). When the device body 1 is vertically installed, the control condition selecting unit 44 selects the vertical fan control unit 46. Then the fan drive unit 47 drives rotatably the fan at, for example, 2500 rpm (step S45).

In other words, the horizontal fan control unit 45 drives rotatably the fan at a predetermined number of revolutions for the horizontal installation. The vertical fan control unit 46 drives rotatably the fan at a predetermined number of revolutions for vertical installation larger than the number of revolutions of the horizontal installation.

Hence, in the case of the vertical installation, since the fan in the fan unit 33 has a large exhaust rate, the inside of the device body 1 is sufficiently ventilated. Thus moisture vapor generated from the recording paper 6 is exhausted certainly and externally out of the device body 1, whereby sweating can be prevented from generating in the process unit.

It is continuously monitored whether printing is proceeding (step S46). When one minute has passed after the completion of the printing operation, the fan ceases its rotation (step S47).

(g) Fixing Unit Control

In the image forming device according to the present embodiment, when power is switched on, the installation direction deciding unit 36 checks the output signal from the optical sensor 15*a* to decide whether the device body 1 is horizontally or vertically installed. If the device body 1 is horizontally installed, the installation direction deciding unit 36 reports the fact that the device body 1 is horizontally installed to the control condition selecting unit 49 of the fixing unit control circuit 48. Then the control condition selecting unit 49 selects the horizontal fixing unit control unit 50.

The horizontal fixing unit control unit 50 temperature-controls the Halogen lamp 52 at, for example, an initial operation according to the control sequence to set the heat roller to a normal fixing temperature.

The vertical fixing unit control unit 51 that is selected by the control condition selecting unit 49 temperature-controls the Halogen lamp 52 to rise once the heat roller to a higher temperature than the normal temperature at, for example, an initial operation and then to return it to the normal temperature.

With the device body 1 vertically installed, the rise of the internal temperature of the device body 1 can exhaust moisture out of the device body 1 so that it is difficult that sweating occurs in the process unit. The process unit is not susceptible to moisture.

When the recording paper 6 is ejected at the completion of the printing operation, the horizontal fixing unit control unit 50 stops the temperature control of the Halogen lamp 52 while the fixing unit drive unit 53 stops rotatably driving the rotational of the heat roller and the pressure roller. The vertical fixing unit control unit 51 stops the temperature control of the Halogen lamp 52 after the recording paper 6 has been ejected at the completion of the printing operation. However, the fixing unit drive unit 53 continues to drive rotatably the heat roller and the pressure roller only for a predetermined time.

After the completion of the printing operation, the operation control of the fixing unit 27 can suppress the temperature rise by sustaining the rotation of the heat roller and the pressure roller for a period longer than that in the horizontal installation.

Next, explanation will be made below in detail as to the control operation of the fixing unit control unit 50 or 51 of the image forming device according to the present embodiment.

Figure 18:
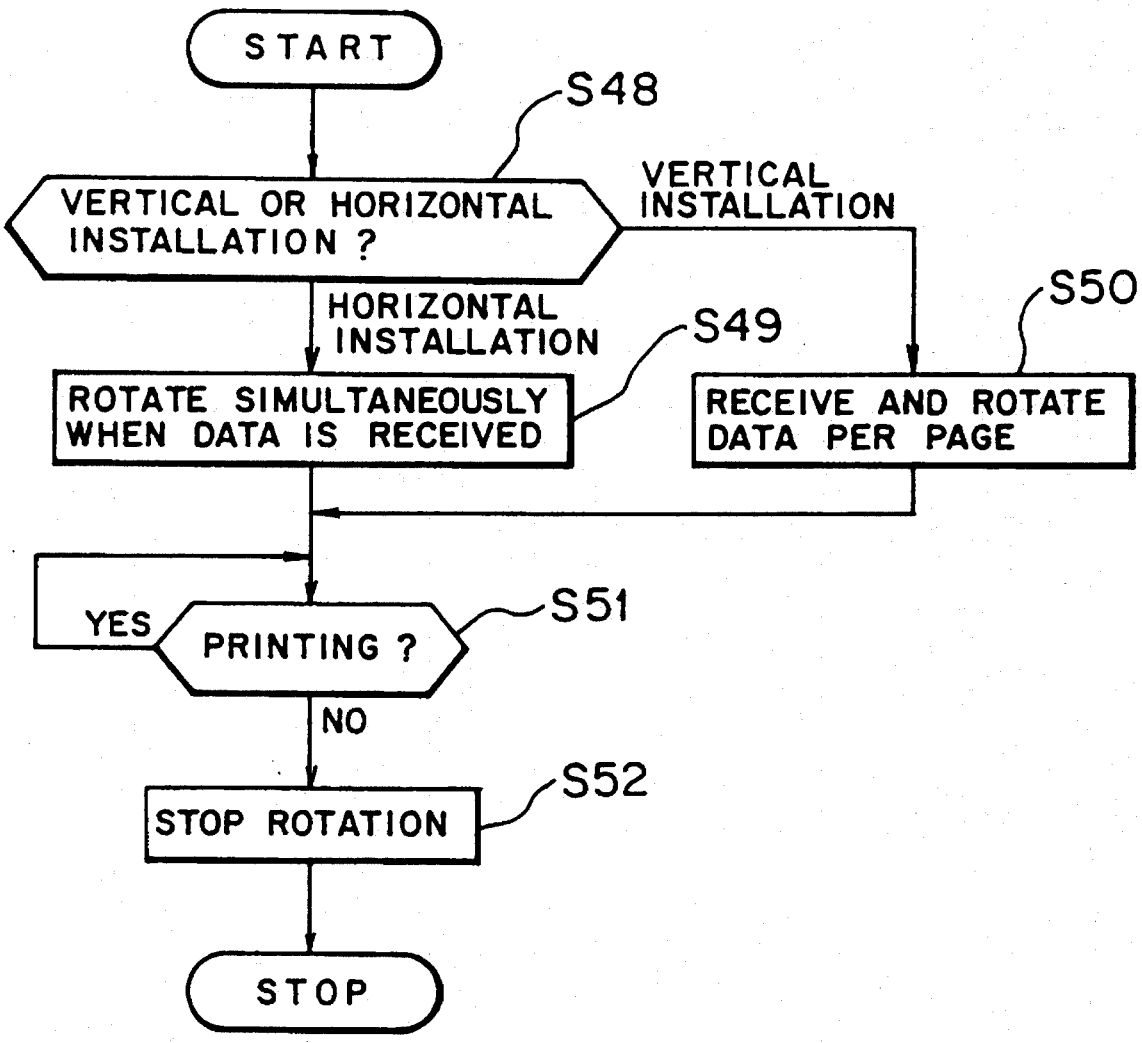
FIG. 18 is a flowchart explaining the control operation of the fixing unit of the present embodiment.

FIG. 18 shows the case where the fixing unit 27 starts rotating the heat roller and the pressure roller at a different timing according to the horizontal or vertical installation of the device body 1. First, the installation direction deciding unit 36 decides the installation direction of the device body 1, based on the output signal from the optical sensor 15*a* (step S48).

With the device body 1 horizontally installed, the control condition selecting unit 49 selects the horizontal fixing unit control unit 50. Then the fixing unit drive unit 53 drives rotatably the heat roller and the pressure roller in the fixing unit 27 in response to image forming data (step S49).

With the device body 1 vertically installed, the control condition selecting unit 49 selects the vertical fixing unit control unit 51. Then the fixing unit drive unit 53 drives rotatably the heat roller and the pressure roller of the fixing unit 27 in response to data for one page (step S50).

In other words, the horizontal fixing unit control unit 50 drives the roller at a predetermined drive timing for the horizontal installation when power is switched on. The vertical fixing unit control unit 51 drives the fan at a timing later than the horizontal installation timing when power is switched on.

In the case of the vertical installation, the roller of the fixing unit 27 does not rotate until data for one page has been received completely after throwing the power source. Hence the temperature of the process unit such as the photosensitive drum 20 rises easily with the temperature rise of the fixing unit 27.

It is monitored whether the printing operation is proceeding at all times (step S51). After the completion of the printing operation, the roller of the fixing unit 27 stops its rotation (step S52).

Figure 19:
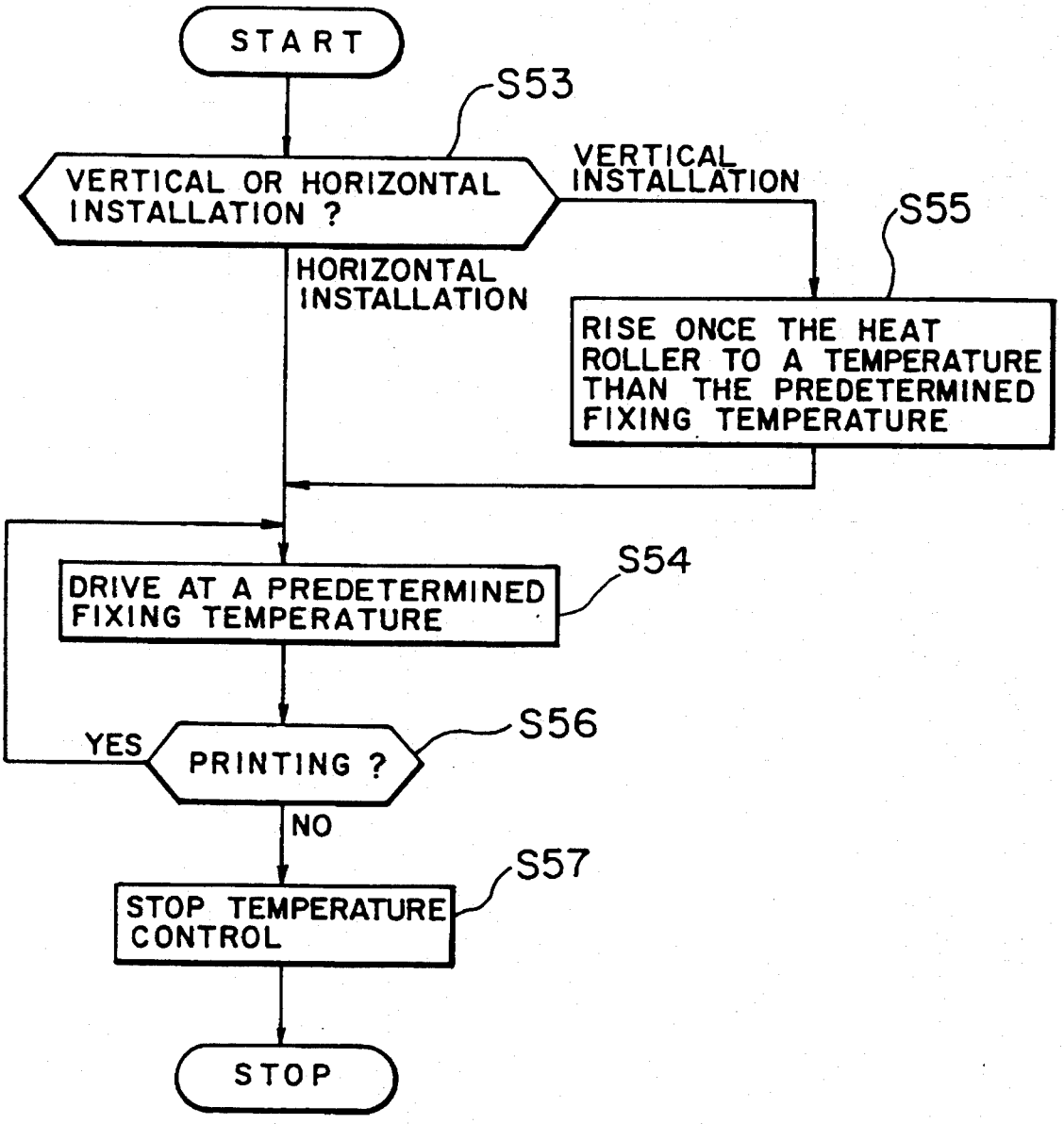
FIG. 19 is a flowchart explaining the control operation of the fixing unit of the present embodiment.

FIG. 19 shows the case where the fixing unit 27 is temperature-controlled differently according to the horizontal or vertical installation of the device body 1. That is, first, the installation direction deciding unit 36 decides the installation direction of the device body 1, based on the output signal from the optical sensor 15*a* (step S53).

With the device body horizontally installed, the control condition selecting unit 49 selects the horizontal fixing unit control unit 50 and controls the Halogen lamp 52 to set the heat roller immediately to a predetermined fixing temperature (step S54).

With the device body 1 vertically installed, the control condition selecting unit 49 selects the vertical fixing unit control unit 51 and then controls to rises once the heat roller to a temperature higher than the predetermined fixing temperature using the Halogen lamp 52 (step S55) and then to return it to the predetermined temperature (step S54).

For that reason, with the device body 1 vertically installed, moisture can be exhausted out of the device body 1 by increasing the internal temperature of the device body 1 before the printing operation. Hence, it is hard that the process unit is sweated so that the process unit is not susceptible to moisture.

It is always monitored whether the printing operation is proceeding (step S56). Then the temperature control of the Halogen lamp 52 is stopped (step S57).

Figure 20:
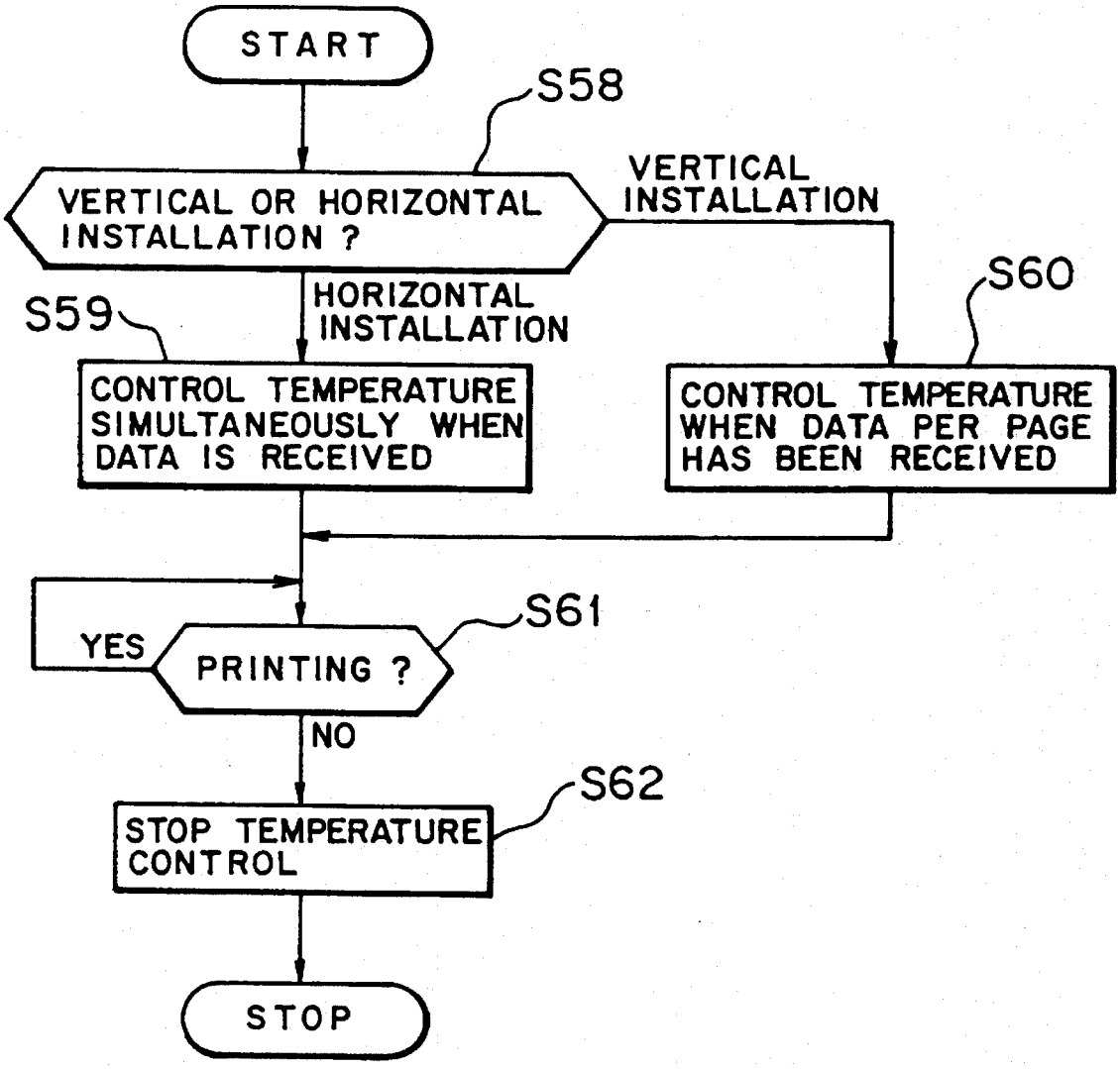
FIG. 20 is a flowchart explaining the control operation of the fixing unit of the present embodiment.

FIG. 20 shows the case where the heat roller temperature control (temperature stabilizing control) of the fixing unit 27 starts at a different timing according to the horizontal or vertical installation of the device body 1. That is, the installation direction deciding unit 36 decides the installation direction of the device body 1, based on the output signal from the optical sensor 15*a* (step S58).

With the device body 1 horizontally installed, the control condition selecting unit 49 selects the horizontal fixing unit control unit 50 and starts the temperature stabilizing control to maintain the heat roller to a predetermined fixing temperature, at the same time the image forming data is received (step S59).

With the device body 1 vertically installed, the control condition selecting unit 49 selects the vertical fixing unit control unit 51 and then receives data for one page to start the temperature stabilizing control that maintains the heat roller of the fixing unit 27 at a predetermined fixing temperature (step S60).

In the case of the vertical installation, the heat roller of the fixing unit 27 is not subjected to the temperature stabilizing control until data for one page is completely received. Moisture can be exhausted out of the device body 1 by increasing the heat roller over the predetermined fixing temperature. Hence it is difficult that sweating occurs inside the process unit so that the process unit is not susceptible to moisture.

It is always monitored whether the printing operation is proceeding (step S61). After the printing operation, the temperature stabilizing control to the heat roller is stopped (step S62).

Figure 21:
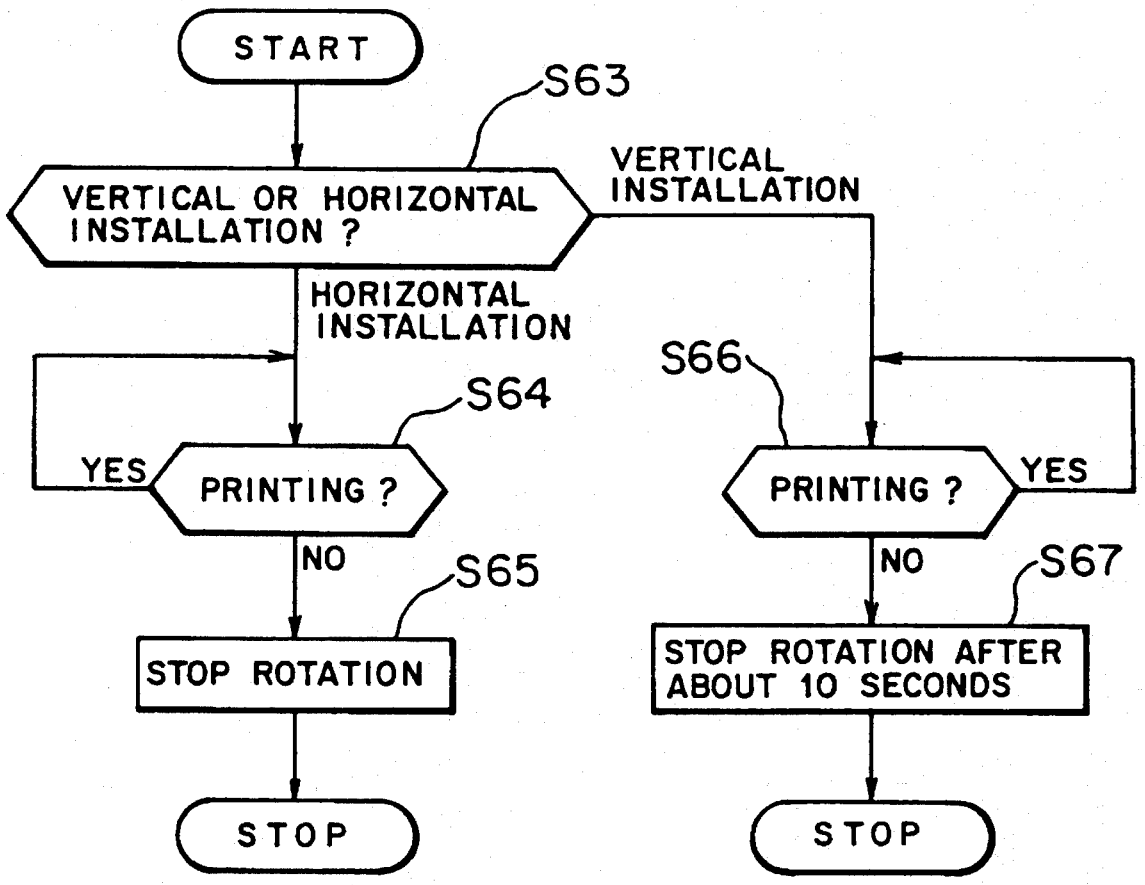
FIG. 21 is a flowchart explaining the control operation of the fixing unit of the present embodiment.

FIG. 21 shows the case where the fixing unit 27 stops the heat roller and the pressure roller at a different timing according to the horizontal or vertical installation of the device body 1. That is, the installation direction deciding unit 36 decides the installation direction, based on the output signal from the optical sensor 15*a* (step S63).

When the device body 1 is horizontally installed, the control condition selecting unit 49 selects the horizontal fixing unit control unit 50 and then stops the heat roller and the pressure roller in the fixing unit 27 immediately at the completion of the printing operation (NO decision in the step S64) (step S65).

On the other hand, when the device body 1 is vertically installed, the control condition selecting unit 49 selects the vertical fixing unit control unit 51 and then stops the rotation of the heat roller and the pressure roller in the fixing unit 27 when about ten seconds has passed after the completion of the printing operation (NO decision in the step S66) (step S67).

In other words, the horizontal fixing unit control unit 50 stops the rotation of the roller of the fixing unit 27 at a predetermined horizontal stop timing after the printing operation. The vertical fixing unit control unit 51 stops the rotation of the roller of the fixing unit 27 at a vertical stop timing later than the horizontal stop timing after the printing operation.

As described above, after the printing operation, the temperature rise can be suppressed by sustaining the rotation of the roller of the fixing unit 27 for a period longer than that in the horizontal installation, whereby an influence of the temperature to the process unit can be suppressed.

Figure 22:
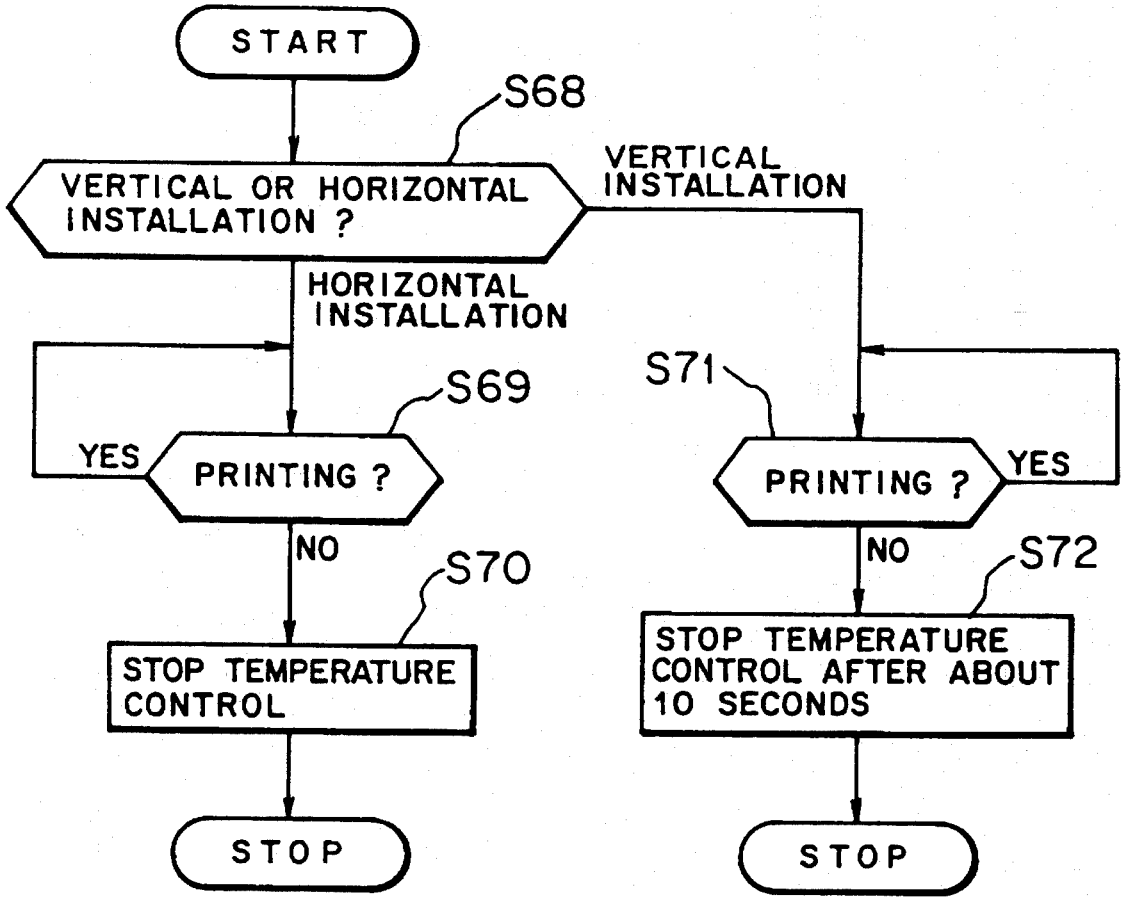
FIG. 22 is a flowchart explaining the control operation of the fixing unit of the present embodiment.
Figure 23:
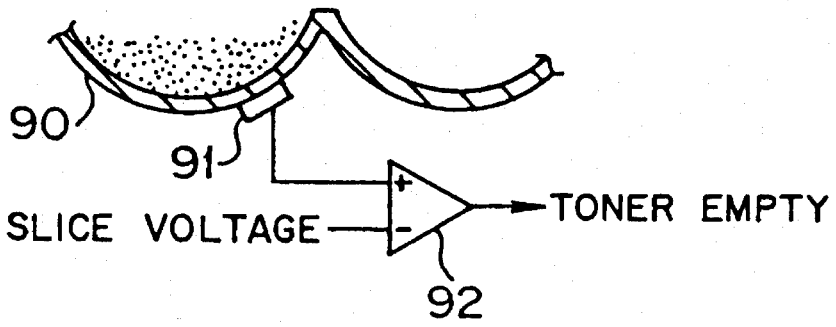
FIG. 23 PRIOR ART
FIG. 23 is a main cross sectional view schematically showing a prior art toner empty detecting mechanism.
Figure 24:
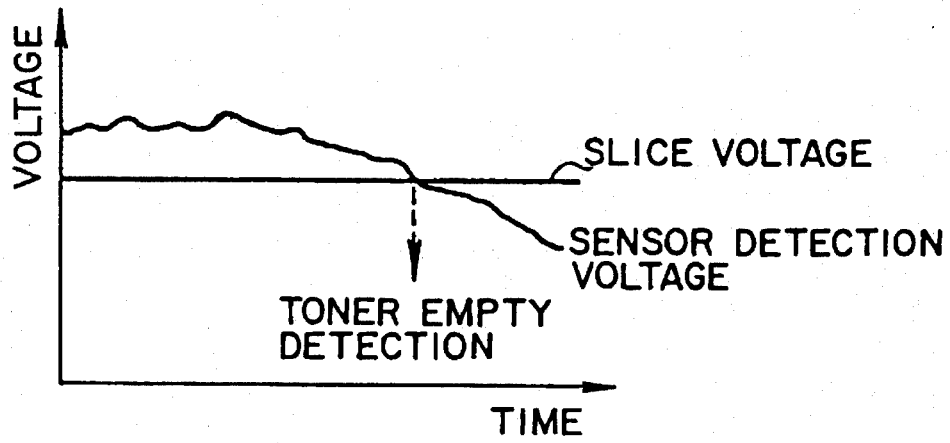
FIG. 24 PRIOR ART
FIG. 24 is a graph explaining the operation of the comparator in the prior art toner empty detecting mechanism.
Figure 25:
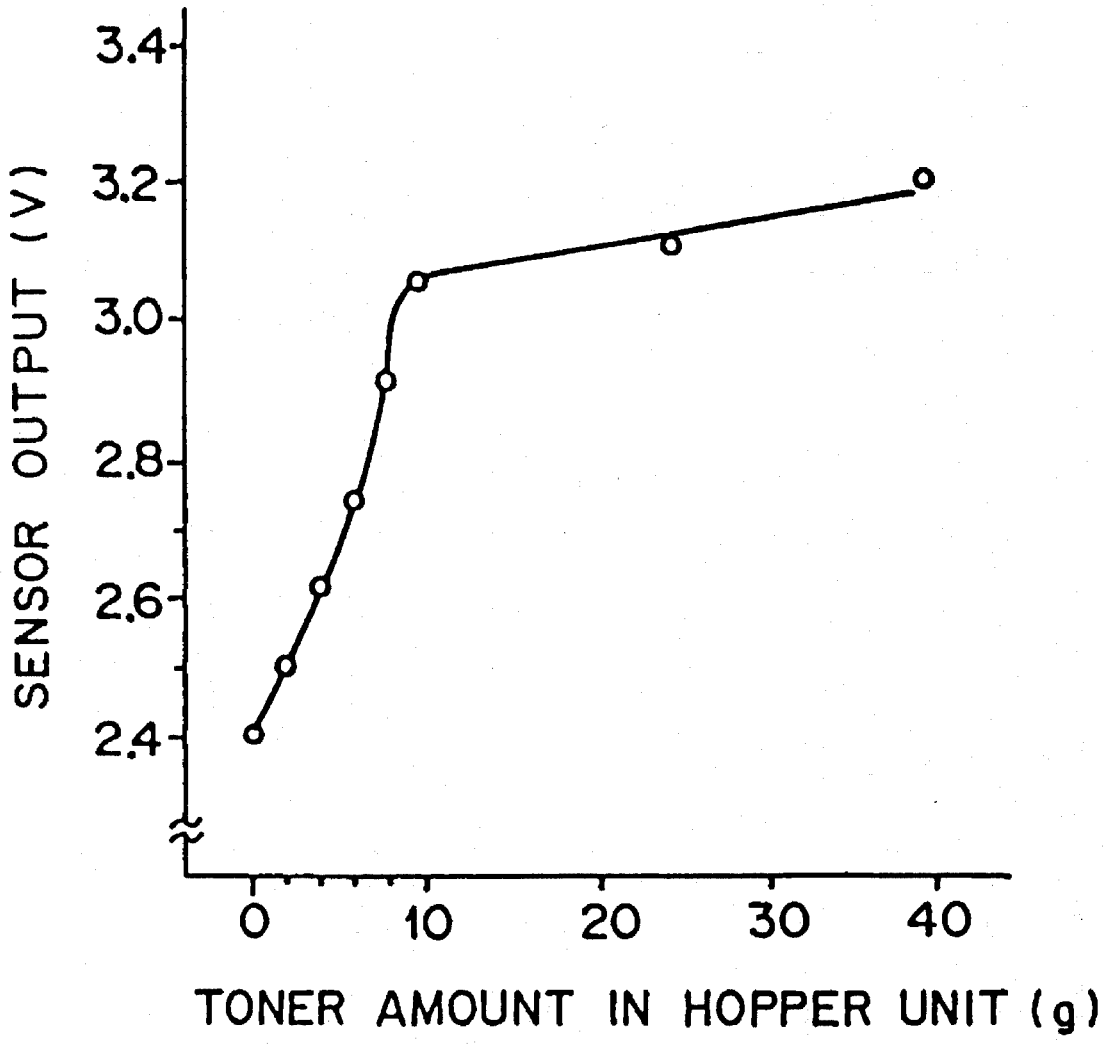
FIG. 25 PRIOR ART
FIG. 25 is a graph showing an output characteristic of a conventional permeability sensor.

Furthermore, FIG. 22 shows the case where the temperature control of the heat roller of the fixing unit 27 stopped at a different timing according to the horizontal or vertical installation of the device body 1. First, the installation direction deciding unit 36 decides the installation direction of the device body 1, based on the output signal from the optical sensor 15*a* (step S68).

With the device body 1 horizontally installed, the control condition selecting unit 49 selects the horizontal fixing unit control unit 50 and then stops the temperature control of the heat roller of the fixing unit 27 immediately when the printing operation has been completed (NO decision in the step S69) (step S70).

Where there is the device body 1 vertically installed, the control condition selecting unit 49 selects the vertical fixing unit control unit 51 and then stops controlling the temperature of the heat roller in the fixing unit 27 when about ten seconds has passed after the completion of the printing operation (NO decision in the step S71) (step S72).

In other words, the horizontal fixing unit control unit 50 stops maintaining controllably the heater of the fixing unit 27 to a predetermined fixing temperature at a predetermined horizontal timing after the completion of the printing operation. The vertical fixing unit control unit 51 stops sustaining the heater of the fixing unit 27 to a predetermined fixing temperature at a vertical stop timing later than the horizontal stop timing after the completion of the printing operation.

As described above, after the printing completion, the procedure shown in FIG. 22 can suppress the temperature rise for a longer period than that in the horizontal installation by controlling the temperature of the heat roller of the fixing unit 27. As a result, the effect of the temperature to the process unit can be suppressed.

According to the present embodiment, since the image forming device can be controlled under the condition corresponding to the installation direction and operate under the control suitable to the installation direction, The simplified configuration can realize its stable image forming operation without depending on the installation direction. Thus the reliability of the image forming process can be largely improved.

In this case, the empty control according to the installation direction of the device body 1 enables the toner empty control without depending on the installation direction. Hence, a stable toner empty detection/display or a near empty detection/display can be performed stably.

Since a desired air flow can be obtained at the optimum timing by controlling the operation of the fan unit 33 according to the installation direction of the device body 1, troubles due to temperature rises or moisture vapor can be prevented before they occurs. Since the fixing unit 27 can be controlled according to the installation direction of the device body 1, a desired amount of heat can be obtained at the optimum timing, whereby generation of waste heat can be prevented. If necessary, sweating due to moisture vapor can be prevented by starting heating with expectation.

In the above embodiments, only the case where the device body 1 operates in two installation direction including the horizontal installation and vertical installation has been described. However, the present invention should not be limited only to the above-mentioned embodiments. The present invention is applicable to the image forming device which operates with its configuration installed in other directions or two or more directions so that functions and effects similar to those in the above embodiments can be obtained. In this case, the control sequence unit that controls under the control condition according to the direction is arranged in the control unit.

The control operation described with FIGS. 11 to 22 may be performed respectively or combined suitably.

What is claimed is:

1. An image forming device that can be installed in either a horizontal or vertical direction, comprising:

a device body;

an installation direction detecting unit for detecting an installation direction of the device body; and a control unit for controlling the operation of the device body according to the installation direction detected by said installation direction detecting unit;

said control unit including a control condition selecting unit for arranging plural control sequence units in the installation direction, said plural control sequence units each for setting a control condition corresponding to the installation direction, and for selecting a control sequence unit corresponding to the installation direction detected by said installation direction detecting unit from said plural control sequence units.

2. The image forming device according to claim 1, further comprising a toner detecting unit for detecting the amount of toner within a toner hopper; and wherein said control unit performs a toner empty control according to the installation direction of said device body, based on an output signal from said toner detecting unit.

3. The image forming device according to claim 2, wherein said plural control sequence units comprise a horizontal toner empty status deciding unit that is selected by said control condition selecting unit when said device body is installed horizontally and a vertical toner empty status deciding unit that is selected by said control condition selecting unit when said device body is installed vertically; said horizontal toner empty status deciding unit comparing the levels of output signals with a horizontal slice level value, said output signal levels sampled in one detection period during which an output signal from said toner detecting unit is sampled a prescribed number of times, said horizontal slice level value calculated by averaging levels of output signals sampled during a previous detection period; said vertical toner empty status deciding unit comparing the levels of output signals with a vertical slice level value, said output signal levels sampled in one detection period during which an output signal from said toner detecting unit is sampled a prescribed number of times, said vertical slice level value calculated by applying a maximum level and a minimum level of output signals sampled during the previous detection period to the following formula: (maximum level−minimum level)×k+minimum level, wherein $0<k<1$.

4. The image forming device according to claim 3, wherein said horizontal toner empty status deciding unit decides as a near empty or toner empty condition in the case where the number of times the level value of an output signal from said toner detecting unit is less than the horizontal slice level during one detection period is a prescribed number of times or more; and wherein said vertical toner empty status deciding unit decides as a near empty or toner empty condition in the case where the number of times the level value of an output signal from said toner detecting unit is continuously less than a vertical slice level during one detection period a prescribed number of times or more.

5. The image forming device according to claim 4, wherein said horizontal toner empty status deciding unit decides as a near empty or toner empty the case where the number of times the level value of an output signal from said toner detecting unit is less than the horizontal slice level during one detection period is a prescribed release number of times or less; and wherein said vertical toner empty status deciding unit decides as a near empty or toner empty the case where the number of times the level value of an output signal from said toner detecting unit is continuously more than a vertical slice level during one detection period a prescribed release number of times or more.

6. The image forming device according to claim 3, wherein said horizontal toner empty status deciding unit decides as a near empty or toner empty condition in the case where a detection period occurs continuously a prescribed number of times, said detection period during which the number of times the level value of an output signal from said toner detecting unit is less than the horizontal slice level during one detection period; and wherein said vertical toner empty status deciding unit decides as a near empty or toner empty condition in the case where the number of times a detection period occurs continuously a prescribed number of times, said detection period during which the level value of an output signal from said toner detecting unit is continuously less than a vertical slice level during one detection period a prescribed number of times or more.

7. The image forming device according to claim 6, wherein said horizontal toner empty status deciding unit releases a toner empty decision where the number of times the level value of an output signal from said toner detecting unit is less than the horizontal slice level is less than a prescribed release number of times during one detection period; and wherein said vertical toner empty status deciding unit releases a toner empty decision where the level value of an output signal from said toner detecting unit is continuously more than a vertical slice level during one detection period a prescribed release number of times or more.

8. The image forming device according to claim 3, wherein said detection period is set to or substantially to one rotation cycle of an agitator that agitates toner in said toner hopper.

9. The image forming device according to claim 8, wherein the output signal from said toner detecting unit is not sampled during a first rotation of said agitator which corresponds to a first detection period of said agitator.

10. The image forming device according to claim 2, wherein said toner detecting unit is equipped outside said toner hopper and formed as a permeability sensor that detects the magnetism of magnetic toner within said toner hopper.

11. The image forming device according to claim 1, wherein said installation direction detecting unit comprises;

a shutter piece rocking according to the installation direction of said device body; and an optical sensor for outputting a detection signal regarding the installation direction of said device body when said shutter piece opens or cuts an optical path according to a rocking position of said shutter piece.

12. The image forming device according to claim 1, further comprising a fan for ventilating and cooling the inside of said device body; and wherein said control unit controls said fan according to the installation direction of said device body.

13. The image forming device according to claim 12, wherein said plural control sequence units comprising:

a horizontal fan control unit that is selected by said control condition selecting unit, in the horizontal state where said device body is horizontally installed and arranged substantially in parallel with a fixing unit and a process unit including a photosensitive drum; and a vertical fan control unit that is selected by said control condition selecting unit, in the vertical state where said device body is vertically installed and said process unit is arranged above said fixing unit.

14. The image forming device according to claim 13, wherein said horizontal fan controlling unit drives said fan at a predetermined horizontal drive timing when the device is powered on; and wherein said vertical fan control unit drives said fan at a vertical drive timing slower than the horizontal drive timing when the device is powered on.

15. The image forming device according to claim 14, further comprising a recording paper passage detecting unit for detecting that a recording paper on which an image is created passes through said fixing unit; and wherein said vertical fan control unit drives said fan when said recording paper passage detecting unit detects a passage of said recording paper in a predetermined period of time from a power-on operation.

16. The image forming device according to claim 13, wherein said horizontal fan control unit stops said fan at a predetermined horizontal stop timing after a completion of an image forming operation; and wherein said vertical fan control unit stops said fan at a vertical stop timing slower than the horizontal stop timing after a completion of an image forming operation.

17. The image forming device according to claim 13, wherein said horizontal fan control unit rotates and drives said fan at a predetermined horizontal number of revolutions; and wherein said vertical fan control unit rotates and drives said fan at a predetermined vertical number of revolutions larger than the horizontal number of revolutions.

18. The image forming device according, to claim 1, wherein said control unit controls the operation of a fixing unit according to the installation direction of said device body.

19. The image forming device according to claim 18, wherein said plural control sequence units comprising:

a horizontal fixing unit control unit that is selected by said control condition selecting unit where said device body is horizontally installed and arranged substantially in parallel with a fixing unit and a process unit including a photosensitive drum; and a vertical fixing unit control unit that is selected by said control condition selecting unit where said device body is vertically installed and said process unit is arranged above said fixing unit.

20. The image forming device according to claim 19, wherein said horizontal fixing unit control unit drives the roller of said fixing unit at a predetermined horizontal drive timing when the device is powered on; and wherein said vertical fixing unit control unit drives the roller of said fixing unit at a vertical drive timing slower than the horizontal drive timing when the device is powered on.

21. The image forming device according to claim 19, wherein said horizontal fixing unit control unit controls a heater in said fixing unit at a predetermined fixing temperature when the device is powered on; and wherein said vertical fixing unit control unit once elevates the heater to a temperature higher than the predetermined fixing temperature in a power-on operation and then sets it to the predetermined fixing temperature.

22. The image forming device according to claim 19, wherein said horizontal fixing unit control unit starts heating a heater of said fixing unit at a power-on operation and then starts a temperature stabilizing control that holds the heater of said fixing unit at the predetermined fixing temperature, at a predetermined horizontal temperature control start timing; and wherein said vertical fixing unit control unit starts heating the heater of said fixing unit at a power-on operation and then starts a temperature stabilizing control that holds the heater of said fixing unit at a predetermined fixing temperature, at a vertical temperature control start timing slower than the horizontal temperature control start timing.

23. The image forming device according to claim 19, wherein said horizontal fixing unit control unit stops the rotation of a roller in said fixing unit at a predetermined horizontal stop timing after a completion of an image forming operation; and wherein said vertical fixing unit control unit stops rotating the roller in the fixing unit at a vertical stop timing slower than the horizontal stop timing after a completion of an image forming operation.

24. The image forming device according to claim 19, wherein said horizontal fixing unit control unit stops a temperature control that a heater in said fixing unit is maintained at a predetermined fixing temperature, at a predetermined horizontal stop timing after a completion of an image forming operation; and wherein said vertical fixing unit control unit stops a temperature control that the heater in said fixing unit is maintained at a predetermined fixing temperature, at a vertical stop timing slower than the horizontal stop timing after a completion of an image forming operation.

25. An image forming device operable in either a horizontal state where a device body is arranged horizontally and substantially in parallel with a fixing unit and a process unit including a photosensitive drum, or a vertical state where said device body is arranged vertically and said process unit is arranged above said fixing unit; and including a moisture absorption sheet between said fixing unit and said process unit.

26. An image forming device operable in either a horizontal state where a device body is arranged horizontally or a vertical state where said device body is arranged vertically, comprising:

a horizontal stack unit for accommodating a recording sheet with an image formed thereon ejected out of said device body, with the surface upon which the image is formed faces downward, said horizontal stack unit being formed on an upper surface of said device body; and a detachable/attachable vertical stacker equipped with said device body against said horizontal stack unit where said device body is installed vertically, whereby a stack space for a recording sheet is formed between said horizontal stack unit and said vertical stacker.

27. The image forming device according to claim 26, wherein where said device body is installed vertically, said device body has a paper ejection aperture arranged downward for ejecting the recording sheet to said stack space, and a lower space extending downward from the paper ejection aperture under the horizontal stack unit.

28. The image forming device according to claim 26, further comprising a pressure member mounted to said vertical stacker for pressing a recording sheet ejected from said paper ejection aperture against said horizontal stack unit.

29. The image forming device according to claim 26, wherein said vertical stacker is formed in a U-shaped form.

* * * * *